US005657711A

United States Patent [19]

Price et al.

[11] Patent Number: 5,657,711

[45] Date of Patent: *Aug. 19, 1997

[54] WAIST BAND ATTACHMENT SYSTEM

[75] Inventors: Elvin C. Price, Dacula; Preston B. Dasher, Lawrenceville; Gerald C. Valentine, Buford, all of Ga.

[73] Assignee: Atlanta Attachment Company, Lawrenceville, Ga.

[ * ] Notice: The term of this patent shall not extend beyond the expiration date of Pat. No. 5,562,060.

[21] Appl. No.: 548,585

[22] Filed: Oct. 26, 1995

Related U.S. Application Data

[63] Continuation-in-part of Ser. No. 503,518, Jul. 18, 1995, Pat. No. 5,562,060, which is a continuation-in-part of Ser. No. 311,921, Sep. 26, 1994, Pat. No. 5,522,332, which is a continuation-in-part of Ser. No. 131,131, Oct. 4, 1993, Pat. No. 5,437,238.

[51] Int. Cl.[6] ..... D05B 21/00

[52] U.S. Cl. ..... 112/470.33; 112/475.02; 112/475.09; 112/470.29; 112/306

[58] Field of Search ..... 112/475.02, 475.09, 112/470.29, 470.31, 306

[56] References Cited

U.S. PATENT DOCUMENTS

| | | | |
|---|---|---|---|
| 4,046,087 | 9/1977 | Manetti | 112/121 |
| 4,053,967 | 10/1977 | Mair | 26/98 |
| 4,265,187 | 5/1981 | Torre | 112/121 |
| 4,473,017 | 9/1984 | Letard et al. | 112/141 |
| 4,484,532 | 11/1984 | Norz | 112/2 |
| 4,681,051 | 7/1987 | Kirch et al. | 112/306 |
| 4,928,610 | 5/1990 | Akutsu | 112/153 |
| 5,029,541 | 7/1991 | Rohr et al. | 112/470.31 |
| 5,251,557 | 10/1993 | Rohr | 112/306 |
| 5,269,239 | 12/1993 | Adamsi, Jr. et al. | 112/121 |
| 5,269,257 | 12/1993 | Yamazaki | 112/262 |
| 5,437,238 | 8/1995 | Price et al. | 112/470 |
| 5,562,060 | 10/1996 | Price et al. | 112/470.29 |

FOREIGN PATENT DOCUMENTS 58-11471 1/1983 Japan .

OTHER PUBLICATIONS

Atlanta Attachment Company Catalog of Automatic Sewing Units, "Sudden Service", pp. 1, 228, 229.

*Primary Examiner*—Paul C. Lewis

*Attorney, Agent, or Firm*—Thomas, Kayden, Horstemeyer & Risley

[57] ABSTRACT

A waist band (18) is placed in straddling relationship about spindles (11–14). The waist edge (24) of the garment body (19) is telescoped about the waist band (18), also in straddling relationship about the spindles (11–14). The garment parts are advanced by the rotation of the spindles (11–14) past a sewing needle (17) that forms a line of stitching at the aligned edges of the shirt body and waist band. In the meantime, the end spindles (11 and 13 and 14) move longitudinally along the sewing path to adjust the position of the waist band in response to the position of the folded edges (22, 23) of the waist band (18) as detected by band sensor (128), and the star wheels (119) engage and urge the waist band (18) and the garment body (19) toward or away from the sewing path (16) as controlled by band and body edge sensors (112, 129). When the previously sewn edges of the garment parts begin to return to the sewing machine (36), one of the spindles (13) moves laterally so as to stretch the garment parts more, so as to remove any bunching of the waist edge (24) of the garment body (19) at the sewing needle (17) and presser foot (39), to avoid forming a wrinkle in the garment body (19) at the end of the line of the stitching (29).

28 Claims, 13 Drawing Sheets

Function (1) Guide tongue assembly 95, edge guide assembly 115, and lever switch 136 move out to operative position (2) Left spindle 11 moves left to stretch garment (3) Puller roll 45 moves down and rotates to pull garment about spindles (4) Initial jog to align edges and right roller expands (5) Upper edge guide unit 117 controls position of shirt edge; and Lower edge guide unit 116 controls position of band edge (6) Decurler air on (7) Edge ejector 51 in guide position (8) Presser foot 32 moves down and stictches 26 being formed (9) Lower right spindle moves to stretch garment

(10) Lever switch 136 engaged by stitches 26

(11) Lever switch 136 retracted edge ejector 51 begins to eject garment progressively

(12) Presser foot raised to initial position and tension on needle thread released as sewing machine sews off garment and sews thread chain

(13) Thread chain severed

(14) Stacker removes work product

Cycle Time

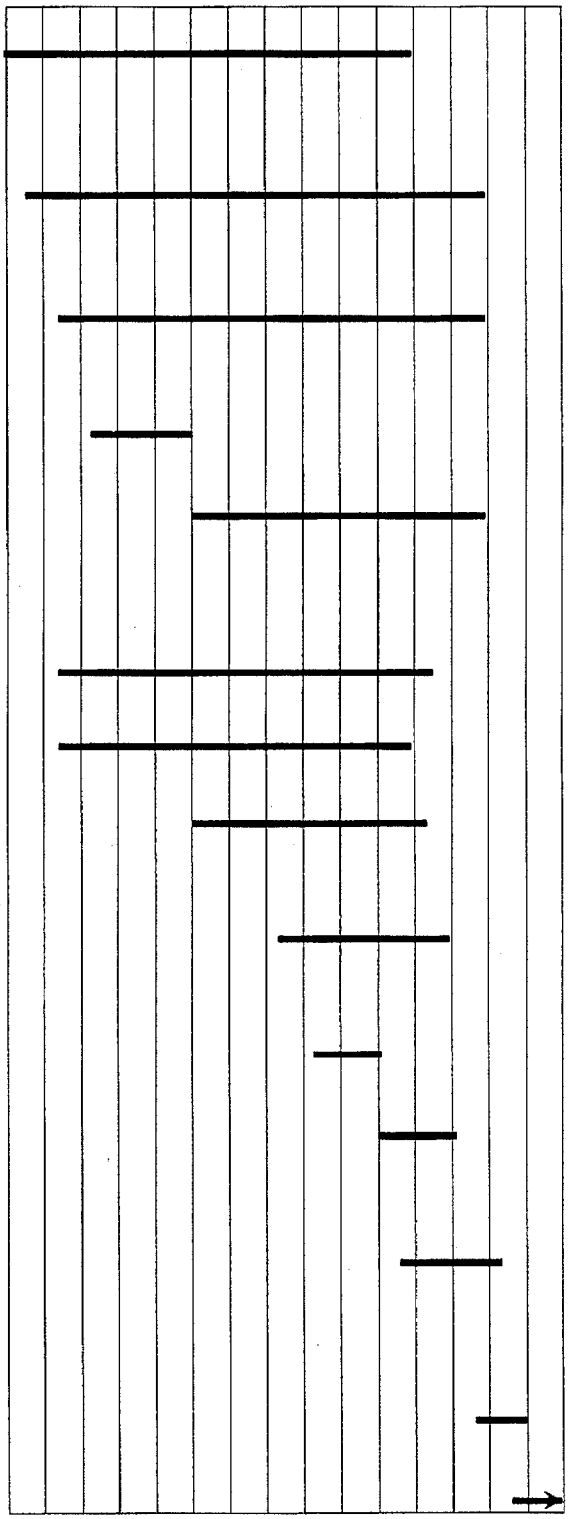

FIG. 17

WAIST BAND ATTACHMENT SYSTEM

CROSS REFERENCE TO RELATED APPLICATION

This is a continuation-in-part of U.S. patent application Ser. No. 08/503,518, filed Jul. 18, 1995 now U.S. Pat. No. 5,562,060, which is a continuation-in-part of U.S. patent application Ser. No. 08/311,921, filed Sep. 26, 1994 now U.S. Pat. No. 5,522,332, which is a continuation-in-part of U.S. patent application Ser. No. 08/131,131 filed Oct. 4, 1993 now U.S. Pat. No. 5,437,238.

FIELD OF THE INVENTION

This invention relates to a method and apparatus for attaching a continuous loop waist band to the continuous waist edge of a garment such as a tubular shirt body or a pair of pants. The waist band material is attached to the waist edge of the garment by matching an edge of the waist band with the waist edge of the garment, stretching both garment parts to substantially the same breadth and advancing the matched edges through a sewing machine.

BACKGROUND OF THE INVENTION

In the production of garments in an industrial setting in which batches of garment parts are delivered to work stations where the garment parts are connected together, it is important that the sewing equipment provided to the worker be fast and efficient in its operation, but also it is important that the garment parts can be expediently loaded on the equipment. Further, it is highly desirable that once the garment parts have been loaded in position and the equipment is placed in operation that the worker be able to momentarily leave the equipment while the equipment continues to operate. This enables the worker to operate more than one machine and to gather more garment parts and match them together for presentation to another duplicate machine for its next cycle of operation.

In the production of stretchable garments, such as sweat suits having a shirt body made of fleece and a waist band of stretchable knit material, it is sometimes difficult for the worker or the equipment to accurately control the material as it is being fed to the sewing machine. For example, when the knitted waist band of a sweat suit is to be connected to the waist edge of the fleece shirt body, the more stretchable waist band may be of smaller breadth than the waist edge of the shirt body when both garments are relaxed. The waist edges of the shirt bodies may vary in breadth from shirt to shirt. When the waist band and the waist edge of the shirt body are being guided to the sewing machine, the waist band usually must be stretched more than the waist edge of the shirt body in order that they are properly matched in breadth as they are sewn together. Further, the edge of the fleece material usually tends to curl as it is stretched, which requires the curled edges to be flattened before they are presented to the sewing needle of the sewing machine. Also, some of the waist bands are cut to improper widths or are cut with non-uniform widths which, when sewn to the shirt body, etc., ultimately causes the garment to be unaccepted.

Because of these inherent problems in presenting the stretchable waist band and shirt or pants body materials to the sewing needles of the sewing machine and operating the equipment, machine operators have been required to develop relatively high skill in presenting the work product to the sewing machine. As a part of the presentation of the work product to the sewing machine, the operators also typically have had to stretch the waist bands, as by pulling the waist bands laterally, to match the waist edges of the garments prior to presenting the waist band materials to the sewing machine. Such a stretching motion becomes extremely tiresome for the operator over the course of a work shift during which 3000–4000 articles are finished. As a result, work productivity is slowed and there is a greater chance of injury occurring.

Further, the presentation of the work product to and the sewing of the work product by the sewing machine requires substantially full attention of the operator during at least some of the cycle of operation of the sewing machine to watch for jamming and the formation of wrinkles about the waist band and waist edge of the garment. This results in the operator not having enough time during the cycle of operation of the sewing machine to retrieve and assemble the next garment parts that are to be presented to the sewing machine or to operate two machines simultaneously.

Accordingly, it can be seen that a need exists for a sewing machine assembly for sewing waist band materials to the waist edges of garments that is easy to load and operate without requiring the complete and exacting attention of the operator so as to enable the operator to perform additional tasks and/or operate additional machines at the same time.

SUMMARY OF THE INVENTION

Briefly described, the present invention comprises a method and apparatus for matching the edges of a loop waist band with the continuous waist edge of a garment such as a shirt body or pair of slacks, stretching the waist band and the garment waist edge until their breadths are matched, and advancing or "prefeeding" the matched edges parallel to and along the sewing path of the sewing machine prior to the sewing cycle for a preliminary alignment run until the edges are automatically aligned along the sewing path of the sewing head and for removing any curl in the matched edges. When the sewing cycle starts, the matched edges of the waist band and garment edge are moved laterally into the sewing path as they continue to move along the path, to assure that no wrinkles are formed in the work product at the beginning of the sewing cycle.

A series of rotatable guide spindles are mounted to the work table of the sewing machine and project out parallel to one another at the sewing machine toward the operator's position. Each of the guide spindles has an elongated, generally cylindrical body, having rounded distal ends projecting laterally from the sewing path. The spindles are initially arranged in a small cluster and the garment parts are placed about all of the spindles. When the system is activated, the spindles spread apart to stretch the garment parts to matching breadths. The spindles tend to hold the waist band and the waist edge of the garment when stretched as the spindles are rotated and the garment parts are moved progressively past the sewing needles of the sewing machine. The operator folds the waist band so that its edges are aligned and then places the waist band in straddling relationship about the spindles with the edges of the waist band matched and being positioned adjacent the sewing path of the sewing machine. When the operator places the waist band about the spindles, the edge of the waist band is detected by a band sensor. The band sensor is a photocell or similar sensing means mounted along the sewing path in a position to detect the edges of the waist band. In response to the waist band moving adjacent the sewing path and triggering the edge sensor, a first spindle is moved longitudinally with respect to the sewing path away from the other spindles to expand the waist band to an initial stretched position.

Also in response to the waist band being placed in its position about the spindles and detected by the band sensor a guide tongue assembly is moveable into the sewing path upstream of the sewing machine. The guide tongue assembly is moved laterally toward the sewing path into a position extending over the waist band substantially simultaneously with the movement with the first spindle away from the other spindles. The guide tongue assembly includes one idler wheel facing upwardly and another idler wheel facing downwardly.

The operator places the waist edge of the garment body in overlying relation about the waist band and about the spindles with the waist edge being substantially matched with the edge of the waist band, and the switch to begin the sewing cycle is closed by the operator. In response to the closing of the switch by the operator to initiate the sewing cycle, the spindles are further separated from one another to expand the waist edge of the garment body and the waist band. As a result, both the waist band and the waist edge of the garment body are under tension and the breadths of the matched edges of the garment parts are substantially the same as they pass through the sewing machine.

In further response the closing of the switch by the operator prior to the start of a sewing operation, an edge guide system is moved into engagement with the garment body and waist band for controlling the positions of the edges of the garment body and the waist band as the parts advance toward the sewing needles. The edge guide system includes upper and lower edge guide assemblies, each including a toothed star wheel received in engagement with an idler wheel of the guide tongue assembly, with the garment body and waist band being engaged between the toothed star wheels of the edge guide assemblies and the idler wheels of the guide tongue assembly.

A decurler is mounted to the guide tongue assembly and includes air nozzles facing the sewing path. The air nozzles direct streams of air across the sewing path, directed at the edges of the waist band and garment body. The flow of air across the edges of the waist band and garment body removes any cud in the edges of the garment parts as the garment parts approach the sewing machine.

Before beginning a sewing cycle a prefeed cycle occurs in which the garment parts are advanced parallel to and slightly displaced from the sewing path with the distance of the prefeeding being sufficient to allow the decurled edges of the garment parts to move from the decurler to the sewing machine needles before the sewing machine is activated. This assures that the edges of the garment parts will be flattened before they are sewn together. The sewing cycle is then begun by moving the garment parts laterally into the sewing needles and on through the sewing path until the work product has been sewn together. Upon the completion of the sewing operation, the guide tongue assembly is retracted outwardly out of the sewing path and thus out of the way of the previously sewn matched edges of the garment parts and the finished garment is removed from the apparatus.

Sensing means are mounted adjacent the sewing path and are connected to reversible step motors for the upper and lower edge guide assemblies. The sensing means includes a band edge sensor mounted to the guide tongue assembly, facing the path of the fold of the band and a body waist edge sensor facing path of the edge of the garment body. Each sensor typically is a photo-cell type sensor. The sensors detect the presence or absence of the folded edge of the waist band and the edge of the garment body, and in response to the sensing of the edges signal the motors to rotate the star wheels of the upper and lower edge guide assemblies. The star wheels are rotated in a reciprocal fashion, clockwise and counterclockwise, depending upon the position of the edges of the waist band and garment body. The star wheels thus continually urge the edges of the garment parts back and forth across the sewing path to maintain the edges of the garment parts in a matched, substantially aligned condition as the edges of the garment parts are moved toward the sewing needles.

Guide sensors additionally are mounted along the sewing path, positioned adjacent the band edge and body waist sensors. The guide sensors generally are photo-cell type sensors that are directed toward the sewing path at points slightly inwardly from the band edge and body edge sensors. The guide sensors control the operation of the upper and lower edge guide assemblies during the initial, prefeed cycle of the system, to cause the edges of the waist band and shirt body to be moved slightly inwardly of the sewing path. As a result, the waist band and shirt body are maintained out of engagement with the sewing needle and cutter of the sewing machine during the preferred cycle to avoid pleating or twisting of the material of the garment parts prior to sewing. As the prefeed cycle ends and the sewing cycle commences, control of the edge guide assemblies, and thus control of the position of the positions of the edges of the garment parts, is transferred from the guide sensors to the band edge and body edge sensors, and the edges of the garment parts are moved laterally into the sewing path for sewing.

After the sewing cycle has been completed and the entire lengths of the edges of the waist band and shirt body have been sewn together, an ejector progressively pushes the matched and now sewn edges of the garment parts laterally out of the sewing path. At the same time, the presser foot of the sewing machine is raised slightly, approximately ⅛ inch to enable the garment to be urged out from under the needle. The garment continues its forward movement along the sewing path as it is progressively moved, by the ejector, out of engagement with the needles until the point where the stitching exits or "sews off" the garment and is located in the proximity of the vacuum trimmer of the sewing machine. The sewing machine, however, continues to sew and produce a thread chain extending from the point where the stitching is sewn off of the garment until the thread chain is severed.

At the same time, when the ejector is actuated, a tension opener is engaged to remove the tension from the needle thread. The tension opener generally comprises an air cylinder to which a push rod is connected. As the air cylinder is actuated, the push rod is urged between the tension plates of the needle tension assembly, spreading the tension plates and thus releasing the tension on the needle thread. As a result, the tensions of the needle and looper threads of the thread chain extending from the garment are substantially balanced and are approximately equal in length. Equalizing the lengths of the needle and looper threads reduces the chances that the threads of the thread chain will fray and pull apart, which would require an additional processing step to trim the chain to acceptable standards, and enables a smooth transition to be formed in the stitching as the sewing machine sews off the garment.

A stacker is positioned adjacent the spindles and provides a movable supply frame for supporting a supply of unfinished garment bodies at the worker's station, and an accumulation frame for receiving the finished garments. A wiper bar flips each garment off the spindles and over the accumulation frame upon the completion of a sewing operation.

Clamp bars mounted to the supply and accumulation frames are moved into engagement with both the supply frame and the accumulation frame simultaneously with the removal of the finished garments to hold the stacks of unfinished garment bodies and finished garments on the supply and accumulation frames.

Therefore, it is an object of this invention to provide an improved method and apparatus for attaching a continuous loop waist band to the continuous waist edge of an approximately tubular body garment such as a tubular shirt body, in which the waist band and shirt body can be presented to the sewing machine by the worker, and the sewing function can commence and continue until completed while the worker is free to perform other functions.

Another object of this invention is to provide an improved waist band attachment system for a sewing machine which functions to feed and decurl automatically the matched edges of a waist band and the waist edge of a tubular shirt body of a sweat suit or similar garment made of stretchable materials as the garment pans move along the sewing path of the sewing machine.

Another object of this invention is to provide an improved set of guide spindles for maintaining the edges of stretchable garment pans in matched alignment while accurately guiding the matched edges of the garment pans along the sewing path of a sewing machine.

Another object of this invention is to provide a method an apparatus for attaching a stretchable waist band to the body of a garment in which the tension on the needle thread is removed so that the lengths of the needle and looper threads are substantially equal so that the thread chain sewn off the garment at the end of the sewing cycle will be of an acceptable length and will be less likely to fray and separate.

Another object to this invention is to provide a system for expediently and accurately loading stretchable garment parts along the sewing path for a sewing machine which permits the garment parts to be loaded in a substantially unstretehed, loose condition and which automatically stretches the garment parts to a stretched, extended position with the edges of the garment parts being matched for accurate and substantially complete attachment of the edges of the garment parts together, which does not require the garment parts to be stretched by the operator as the parts are loaded into the apparatus for sewing.

Still another object of this invention is to provide a garment support assembly mounted to a work table of a sewing machine for supporting a supply of unfinished garments and the accumulation of finished garments, which can be rapidly adjusted to accommodate different size garments and which functions to remove automatically the finished garments from the sewing machine upon the completion of a sewing operation, and which includes means for clamping and holding stacks of finished and unfinished garments during movement of the support assembly for the removal of a garment from the sewing apparatus.

Other objects, features and advantages of the present invention will become apparent upon reading the following specification, when taken in conjunction with the accompanying drawings.

BRIEF DESCRIPTION OF THE DRAWINGS

FIG. 17 is a schematic illustration of the cycle time for the major functions of the system.

DETAILED DESCRIPTION

Figure 1:
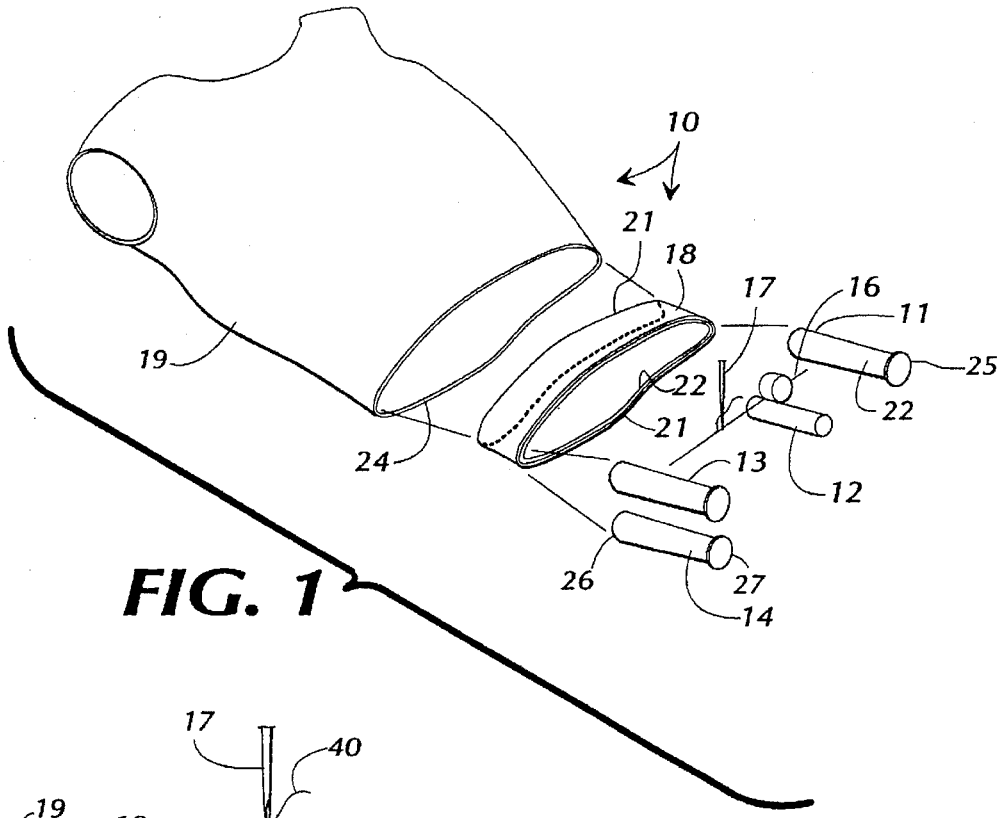
FIG. 1 is a perspective illustration of a tubular shirt body and a waist band of a garment prior to being connected together, illustrating how those parts of the garment would be placed in straddled relationship about the guide spindles of the system.
Figure 2:
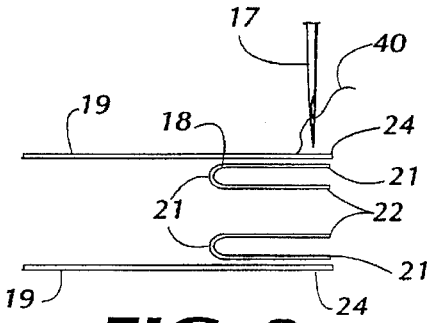
FIG. 2 is a schematic illustration of the waist band and shirt body showing how the waist band is folded and how the waist edge of the shirt body is aligned with the matched edges of the waist band.

Referring now in more detail to the drawings, in which like numerals indicate like parts throughout the several views, FIG. 1 illustrates a garment 10 placed in straddling relationship about a series of guide spindles 11, 12, 13 and 14 and moved along a substantially circular sewing path, shown by arrows 16, into engagement with a sewing needle 17 of a sewing machine. The garment is comprised of parts including a knitted continuous loop waist band 18 and garment body such as a fleece shirt body 19. As shown in FIGS. 1 and 2, the knitted waist band is folded over along its length, as shown by 21, so that its edges 22 and 23 are in an overlying aligned relationship. The edges are placed in the sewing path 16 which extends beneath a sewing needle 17, with the fold 21 of the waist band 18 facing away from the sewing needle. The shirt body 19 has a waist edge 24 that is placed in the sewing path in overlying alignment with the edges 22 and 23 of the waist band 18.

Typically, the sewing machine operator folds the waist band by hand and then places the waist band about the spindles 11–14 as indicated in FIG. 1. Spindles 11, 12, 13 and 14 each are elongated, substantially cylindrically shaped members with a rounded, tapered proximal end 26 and a distal end 27. The aligned edges 22 and 23 of the waist band 19 are moved by the sewing machine operator onto the spindles, received over the tapered proximal ends thereof and approximately in alignment with the distal ends 27 of the spindles. The spindles support and guide the waist band and shirt body along the sewing path 16 for attaching and trimming, and uniformly stretch the waist band to a predetermined width to match the waist edge of the shirt body.

Figure 3A:
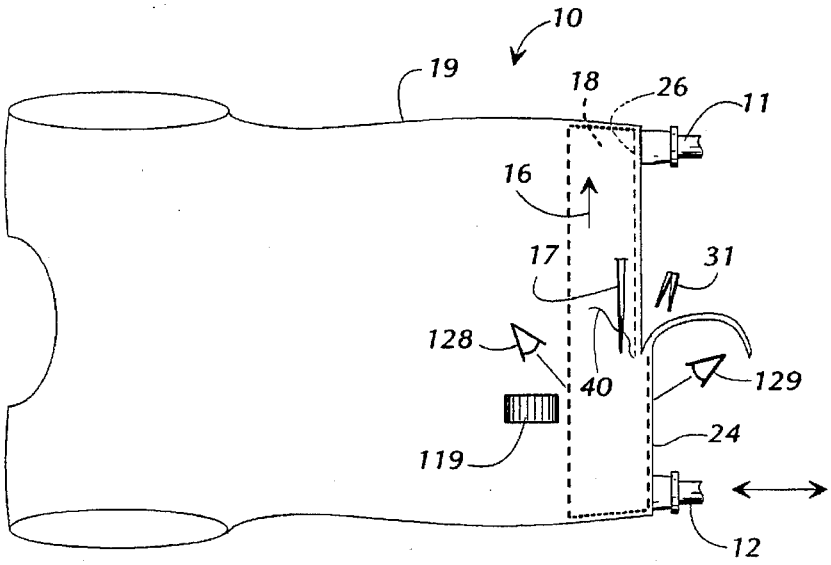
FIG. 3A is an illustration of the shirt body and the waist band, showing schematically how the parts are guided and sewn together.
Figure 3B:
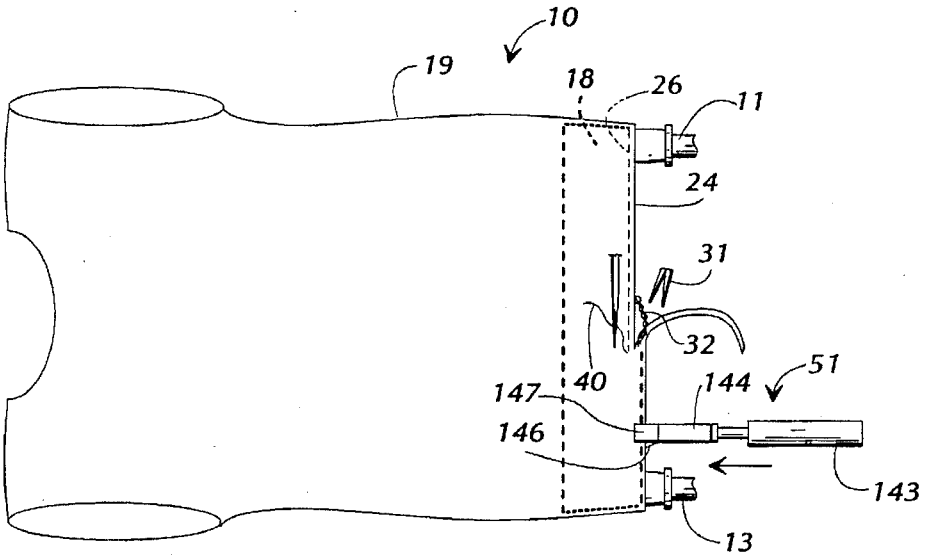
FIG. 3B is a schematic illustration of the completion of the sewing operation and the sewing off of the garment by the sewing needle.

Once the knitted waist band has been received on the spindles, the operator then places the waist edge 24 of the shirt body 19 in telescoped relationship about the waist band 18 until its waist edge is aligned with the edges 22 and 23 of the waist band 18. As shown in FIG. 2, the aligned edges 22, 23 and 24 are placed in the sewing path 16, in alignment with the sewing needle 17 of the sewing machine. As illustrated in FIG. 3A, the waist band 18 and shirt body 19 are moved in the direction indicated by arrow A about the spindles 11–14 and the sewing needle 17 forms stitches 29 at the aligned edges 22, 23 and 24 of the garment parts. Generally, the stitches 29 are formed as overedge chain stitches extending about the edges 22, 23, and 24 of the garment parts. A conventional trimmer 31 cuts a portion of the garment parts that overlie the sewing path away from the garment parts, thereby assuring the finished garment has neat, aligned edges. As the sewing operation nears completion, as shown in FIG. 3B, the garment is progressively urged out of the sewing path 16 so that the sewing needle sews off of the garment and forms a thread chain 32 extending from the garment.

Figure 4:
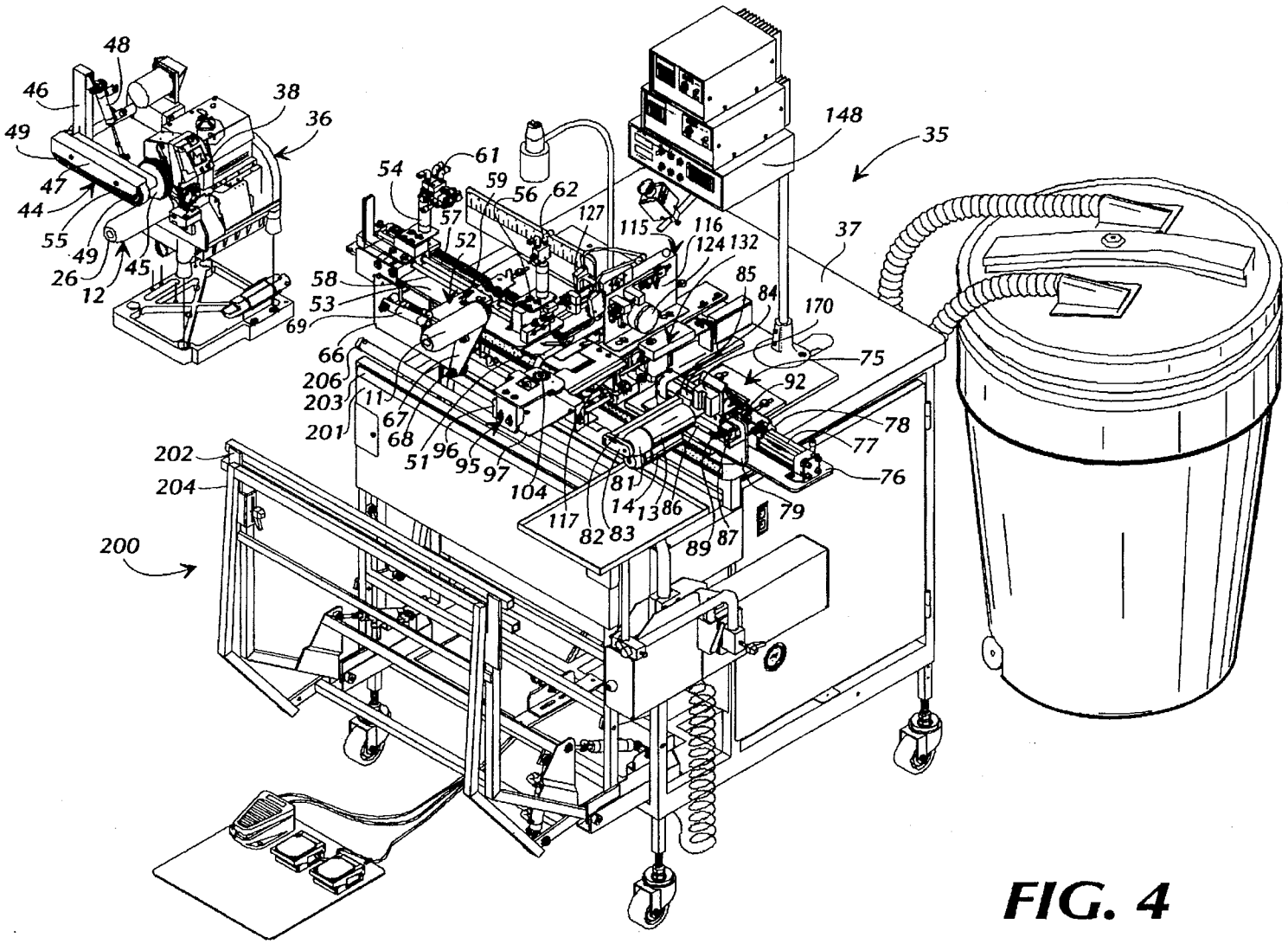
FIG. 4 is a perspective illustration of the waist band attachment system.
Figure 5:
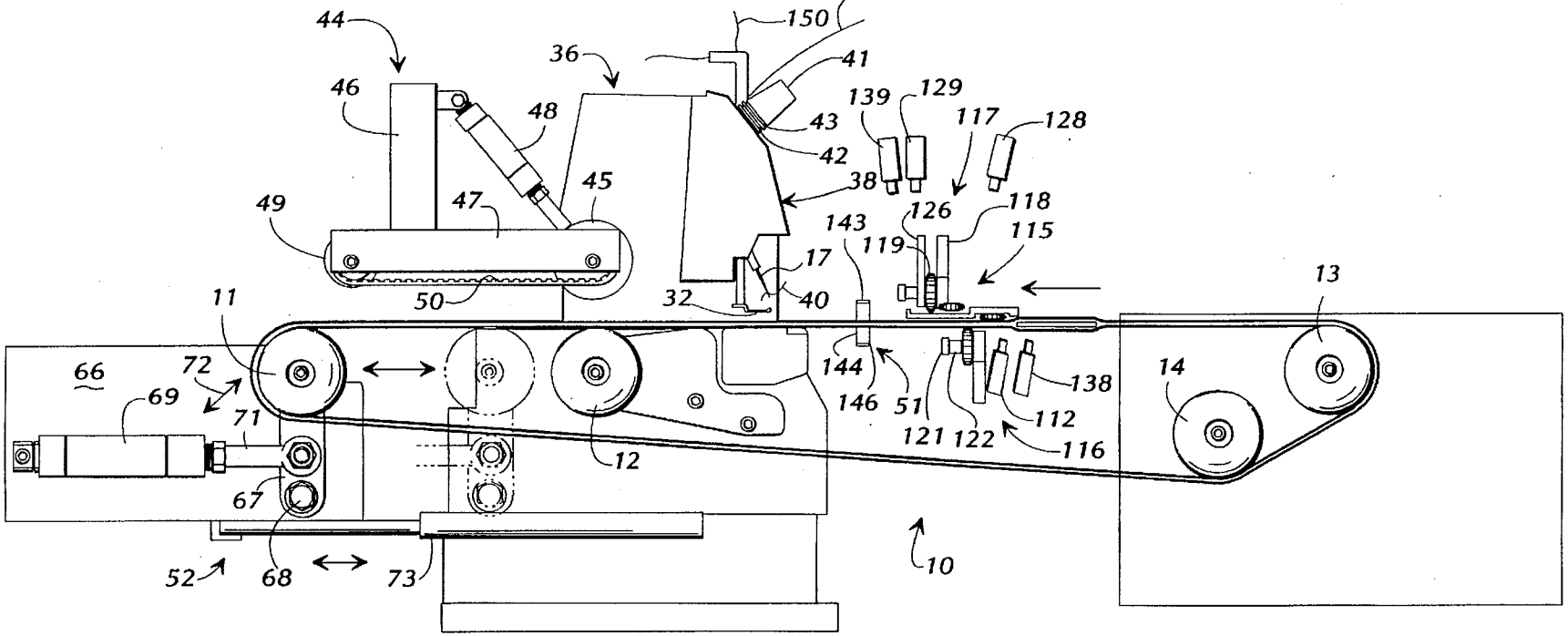
FIG. 5 is a front schematic illustration of the system of FIG. 4, showing how the guide spindles function to guide the garment parts through the sewing machine.

As generally illustrated in FIGS. 4 and 5, wherein the operative components are shown for performing the functions illustrated in FIGS. 1–3, the waist band attachment system 35 includes a sewing machine 36 which is mounted on a work table 37 for the waist band attachment system. The sewing machine 36 includes a sewing head 38 positioned above the sewing path and which includes the sewing needle 17, loopers (not shown) and the presser foot 39 of the sewing machine. A series of threads 40, 40' and 40" are supplied to the sewing needle and loopers from thread supply rails (not shown) for forming the overedge stitching 29 (FIG. 3A). Thread tensioners 41, 41' and 41" (FIG. 4) are mounted to the sewing machine adjacent the sewing head 38. The thread tensioners each include a pair of opposed tension plates 42 and 43 between which the threads are received, and a compression spring (not shown) that biases the upper tension plate 43 toward tension plate 42 to apply tension to the thread received therebetween. The threads 40, 40' and 40" pass through the thread tensioners, extending to the needle and loopers, and are placed under a desired degree of tension according to the desired tightness of the stitches to be formed in the garment.

A garment puller 44 is mounted adjacent and in operative relationship with respect to sewing head 38 and guide spindle 11. Garment puller 44 is mounted above and along the sewing path 16 and includes a toothed puller wheel 45 that is mounted to a pivot arm 46 that moves the puller wheel downwardly toward and upwardly away from engagement with spindle 12, as indicated by arrows B and B'. The pivot arm 46 is pivotally mounted at its opposite end to an upright support arm 47. Pneumatically actuated cylinder 48 is mounted to the support arm 47 and to the distal end of the pivot arm 46 and controls the arcuate movement of pivot arm.

Figure 6:
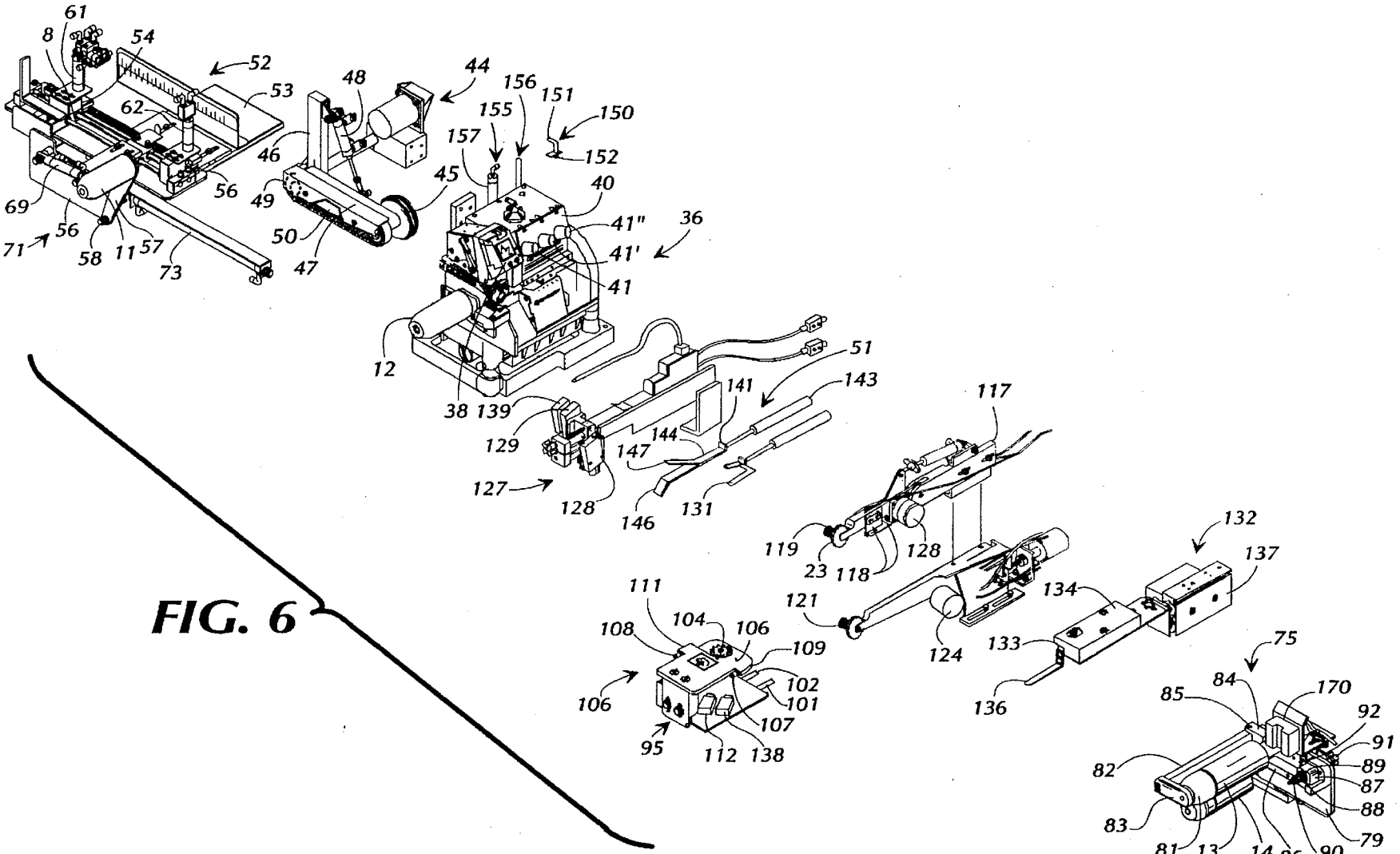
FIG. 6 is an expanded perspective illustration of the major components of the system.

A reciprocally stepping motor is connected to a sprocket 49 mounted at the base of pivot arm 47 for rotating the sprocket. A drive belt 50 is encircled about the sprocket 49 and puller wheel, linking the sprocket and puller wheel in a driving relationship so as to cause the puller wheel to rotate in a clockwise direction with the rotation of the sprocket by the motor. The spindle 12 of sewing head 38 functions as an idler spindle, which is positively rotated by the rotation of the drive wheel when the puller wheel is moved down into its operative position with the waist band and shirt body engaged between the puller wheel and the spindle 12. A garment ejector 51 is mounted adjacent the sewing head 38, positioned along the sewing path upstream from the garment puller 44 for ejecting the garment from the system upon completion of the sewing operation. FIG. 5 shows sewing head 38, garment puller 44, garment ejector 51 and spindles 11–14 in side elevation. FIG. 6 shows these same components of the system in more detail.

Figure 7:
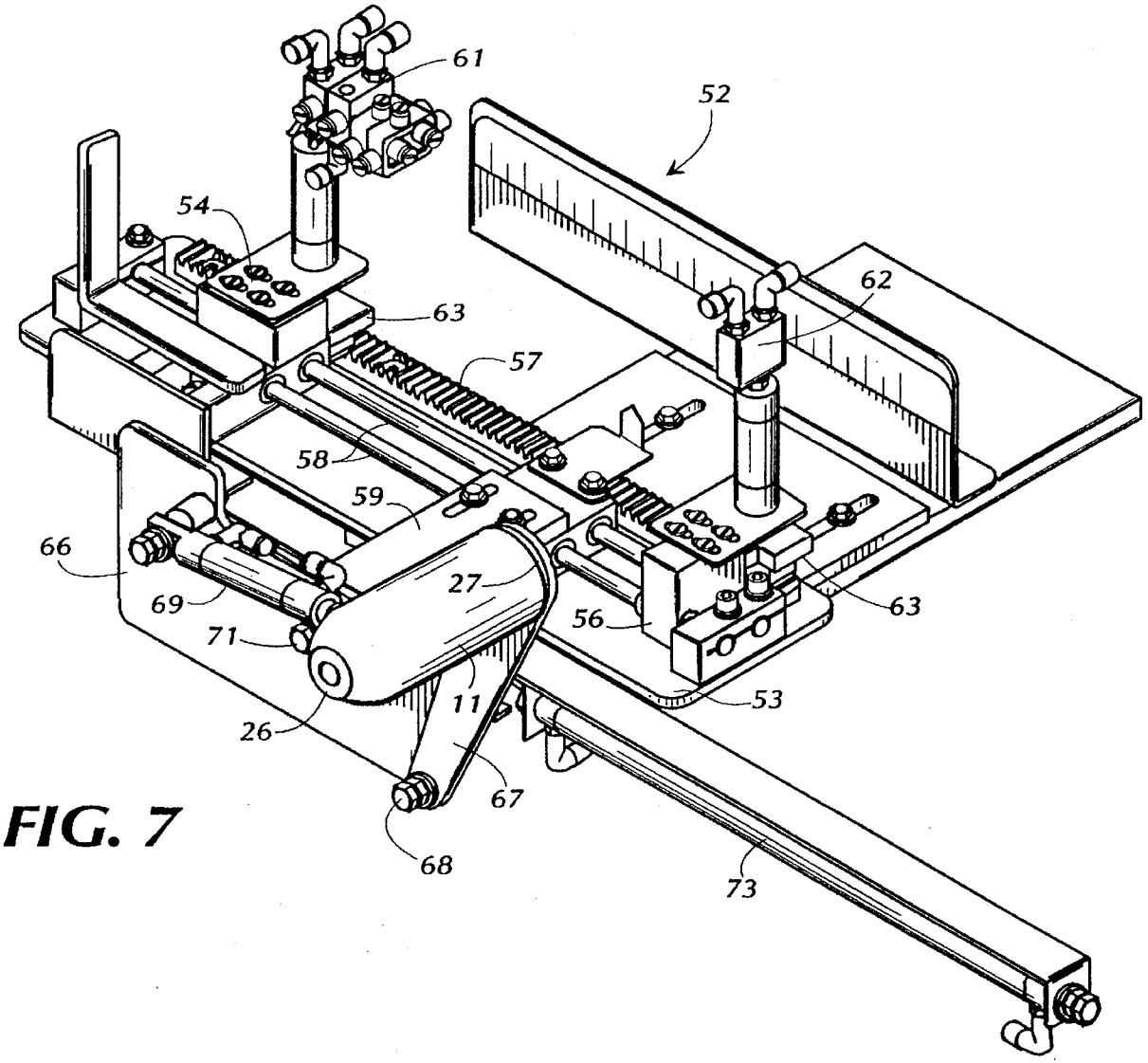
FIG. 7 is a perspective illustration of the left guide spindle assembly of the invention.

As shown in FIGS. 6 and 7, the left most spindle 11 is mounted to a first movable guide spindle assembly 52. Spindle assembly 52 includes a mounting plate 53 that is attached to the work table, and slide bar mounts 54 and 56 attached to a track 57 mounted to the mounting plate 53. Slide bars 58 extend between and are supported by the slide bar mounts 54 and 56. A slide block 59 is mounted on and is movable along slide bars 58, with the movement at the slide block limited by the spacing of the slide bar mounts. Locking cylinder assemblies 61 and 62 are mounted to the slide bar mounts 54 and 56 for locking the slide bar mounts in a desired position along the track 59. The locking cylinder assemblies generally are pneumatically actuated cylinders and each include lock plates 63 movable into and out of locking engagement with the teeth of track 57 upon actuation of the cylinders so as to hold the slide bar mounts in a desired, set position with respect to the mounting plate. The slide bar mounts are movable along the track 57 and are locked in place by the locking cylinder assemblies 61 and 62 (FIG. 7) to enable the spacing between the slide bar mounts and thus the range of movement of the slide block, to be set as desired. This enables adjustment of the amount of movement of the spindle toward and away from sewing head 38 for the purpose of size adjustment with respect to larger and smaller of the garment parts.

An upright support plate 66 is mounted to the slide block 59, and is movable longitudinally with the movement of block 59 along the slide bars 58. A pivot arm 67 is pivotedly mounted to the upright support plate at its lower end by pivot pin 68, with spindle 11 rotatably mounted to the upper end of the pivot arm. A pneumatically actuated cylinder 69 is mounted to the upright support plate 66, extending along the front surface thereof, and includes piston rod 71 that is attached at its free end to the pivot arm 67 at a point intermediate the pivot pin 68 and spindle 11. When cylinder 69 is actuated, the pivot arm is pivoted about pivot pin 68 such that spindle 11 is moved through an arcuate path as indicated by double-headed arrow 72 generally toward and away from sewing head 38.

As shown in FIGS. 6 and 7, an elongated air cylinder 73 is positioned below the first spindle assembly 52, extending along the sewing path. Elongated air cylinder 73 is a pneumatically operated cylinder having a piston rod (not shown) to which the upright support plate 66 is mounted. The upright support plate moves longitudinally between the slide bar mounts 54 and 56 by the extension and retraction of the piston rod of air cylinder 73. As a result, spindle 11 is moved between a nonoperative, resting position (FIG. 4) and its operative, initial stretching position (as shown in FIG. 5) upon the actuation of air cylinder 73.

A second or right side guide spindle assembly 75 is shown at the right side of FIG. 6, which assembly is on the other side of sewing head 38 from the first spindle assembly 52. The second spindle assembly 75 (FIGS. 6 and 8) is actuated at the start of a sewing operation to stretch the garment toward the right side of the waist band attachment system. The second spindle assembly includes a mounting plate 76 (FIG. 8) attached to the work table of the waist band attachment system and having a rodless pneumatic cylinder 77 mounted thereon. The rodless cylinder generally includes a carriage 78 that is movable along the length thereof. An upright support plate 79 is mounted to the carriage 78 and thus is movable along the length of cylinder 77 with the movement of carriage 78 therealong.

Spindles 13 and 14 are mounted to the front facing surface of the support plate 79, spaced vertically from one another and extending in a direction normal to the sewing path. The spindles 13 and 14 are movable in a direction parallel to the sewing path with the movement of the support plate 79 along the cylinder 77 to stretch the garment body and waist band to a desired tension for sewing as shown in FIG. 5. The spindles can be tilted or reoriented with respect to the sewing path by an adjustment knob 80 (FIG. 8) extending between the support plate 79 and carriage 78. The adjustment knob causes the support plate, and thus guide spindles 13 and 14 to be tilted toward or away from the carriage, and thus to tilt with respect to the sewing path as desired.

Figure 8:
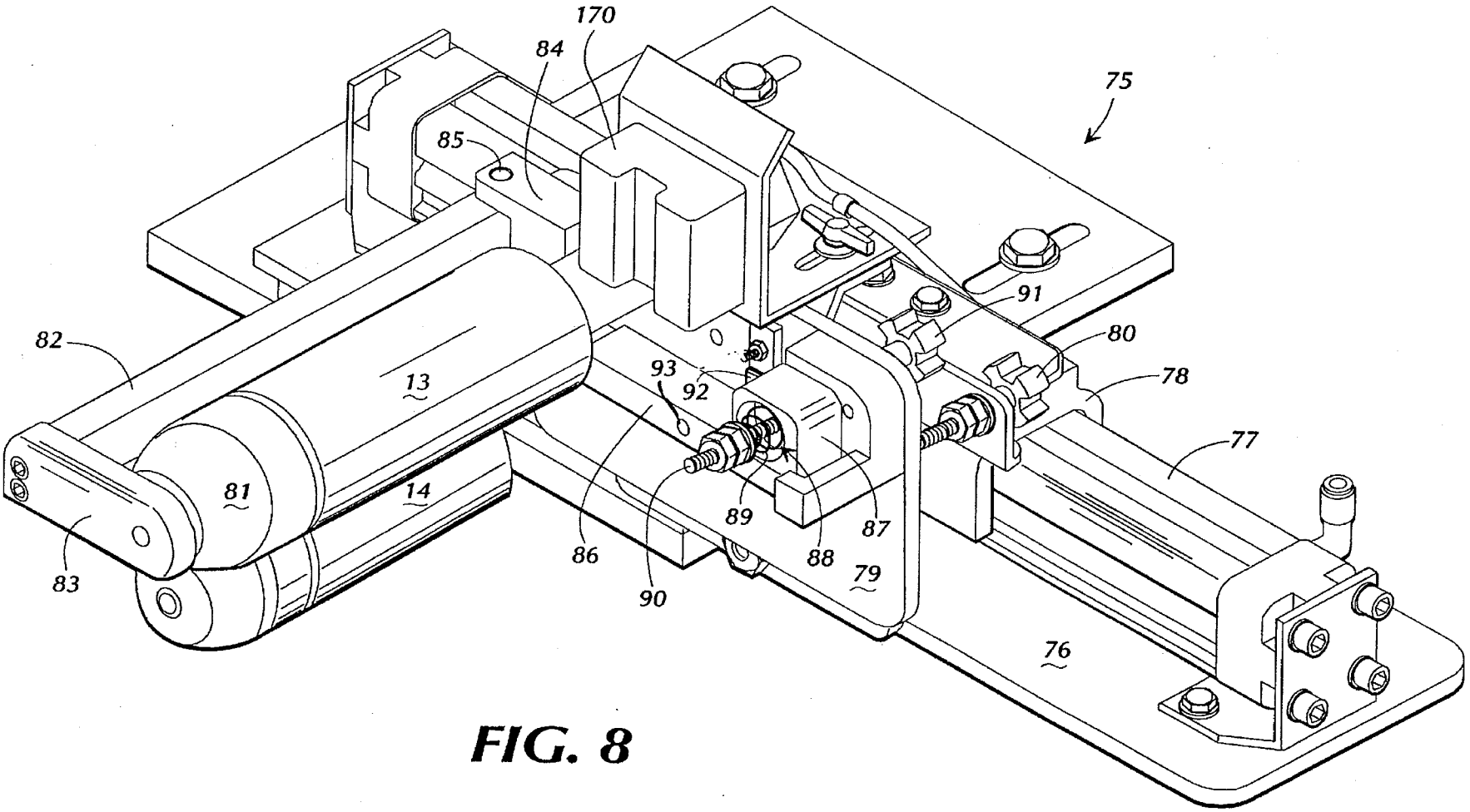
FIG. 8 is a perspective illustration of the fight spindle assembly.

As illustrated in FIG. 8, spindle 13 includes a nose portion 81 connected to a pivot arm 82 by a connector bracket 83. The nose portion 81 is loosely attached to the body of spindle 13 so as to be movable laterally with respect to the body of the spindle in a direction substantially parallel to the sewing path as tension in the garment increases as the garment body is stretched by the movement of a spindles 13 and 14 along the sewing path by cylinder 77. The pivot arm 82 is an elongated bar attached at a first end to the nose portion 81 of spindle 13 by bracket 83, and pivotally attached to the support plate 79 at its opposite or second end by a clevis 84 mounted to the support plate. A pivot pin 85 connects the second end of pivot arm 82 to the clevis 84 to enable the pivoting movement of pivot arm 82 with the lateral movement of the nose portion 81 of the spindle 13.

A spring arm 86 extends along the front of the support plate 79, attached at one end to the pivot arm 82 adjacent the second end thereof so as to be movable with the pivoting movement of the pivot arm 82, and attached at its opposite end to a spring block 87. As shown in FIG. 8, the spring block 87 comprises a square shaped block having a pocket 88 formed therein and is movable toward and away from the support plate with the movement of the spring arm 86 and pivot arm 82. A compression spring 89 is received within the pocket 88, attached thereto by a fastener 90, such as a nut and bolt, that extends through the spring block and the support plate 79. The fastener 90 further includes an adjustment knob 91 that can be manipulated to adjust the tension of the spring 89, and thus the desired amount of tension under which the garment is to be placed to avoid bunching or wrinkling of the garment during a sewing operation. The spring 89 biases the spring block 87 toward the support plate to resist movement of the spring block, and thus movement of the spring arm 86, pivot arm 82 and nose portion 81 of spindle 13, until the tension in the garment body pulling on the nose portion is sufficient to overcome the force of the spring 89.

A proximity switch 92 is mounted to the support plate 79 adjacent the spring block 87. The proximity switch 92 senses the movement of spring block away from the support plate in response to the increase in tension in the garment body pulling against the nose potion 81 of spindle 13. In response, the switch 91 stops the further movement of the carriage 78 along cylinder 77 to halt the stretching of the garment body. It will be understood that while switch 92 is disclosed as a proximity switch, it is possible to use other types of switch or sensing means as desired. The swing of the garment is not permitted to commence until the tensioning of the garment by the second guide spindle assembly is completed, and thereafter, the tensioning of the garment by the second guide spindle assembly is temporarily deactivated as the garment is sewn.

An adjustment set screw 93 moves in and out to adjust the sensitivity of the switch 92. Additionally, limit switches (not shown) are mounted along cylinder 77. The limit switches enable the travel of the carriage 78 along the cylinder 77 to be substantially fixed for small, medium and large size garments, with any minor differences in the sizes of the garments being detected and compensated for by the live sensing of increases in tension by the nose portion 81 of roller 13.

Figure 9A:
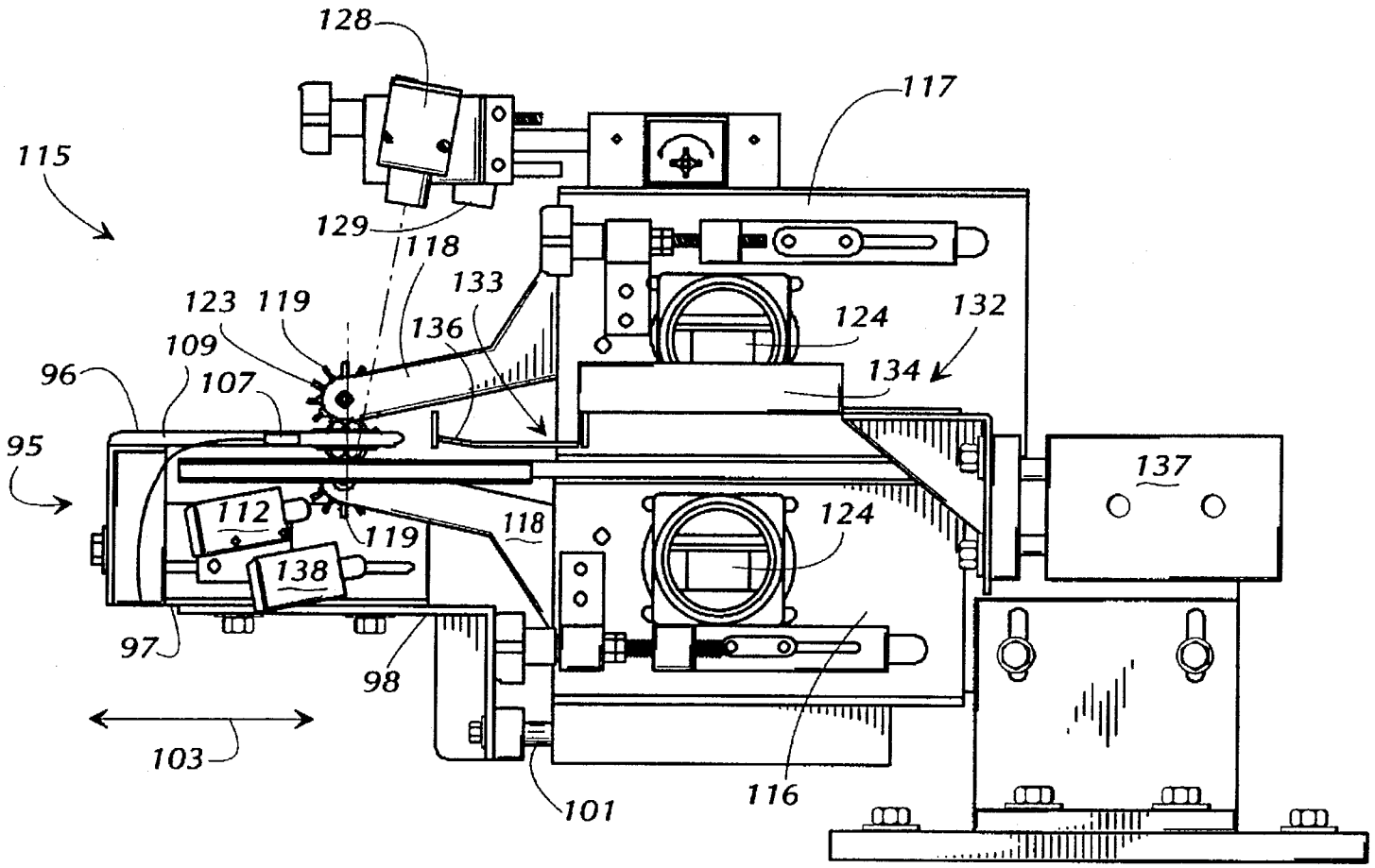
FIG. 9A is a side elevational view of the edge guide system and the guide tongue assembly.
Figure 9B:
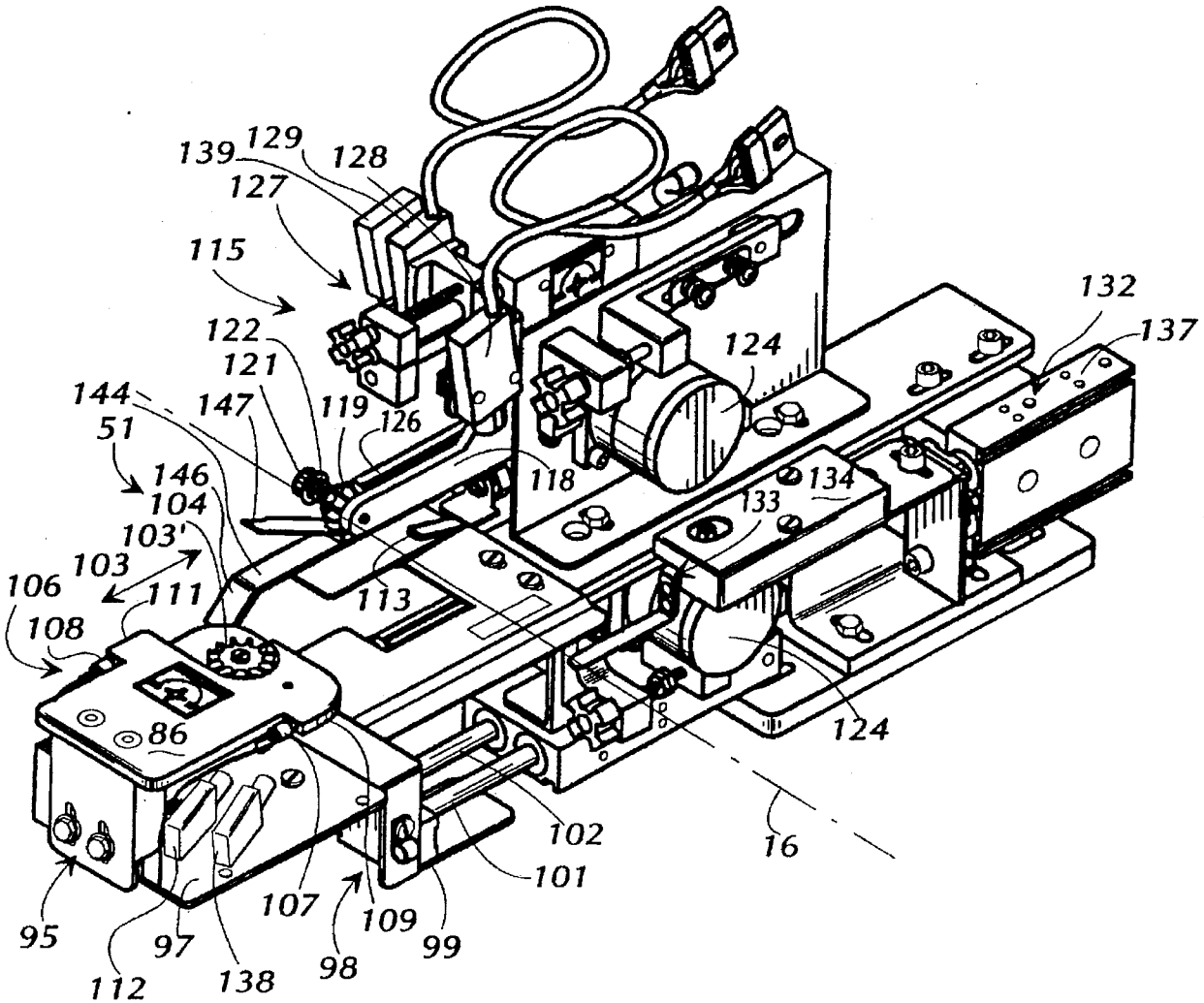
FIG. 9B is a perspective illustration of the edge guide assembly and the guide tongue assembly.

A guide tongue assembly 95 (FIG. 4) is positioned along the sewing path, movably mounted to the work table 37 of the waist band attachment system 35 and positioned upstream from the sewing head 38. As shown in FIGS. 6, 9A and 9B, the guide tongue assembly is a substantially C-shaped shelf generally positioned outside of the sewing path of the waist band attachment system until actuated, and includes a horizontally oriented upper support plate 96 and a horizontally oriented lower plate 97 extending parallel to and spaced from the upper support plate 96. A substantially L-shaped mounting bracket 98 is attached to the downwardly facing surface of lower plate 97, extending toward the sewing path and having a downwardly extending front portion 99. Piston rods 101 and 102 of a pair of air cylinders (not shown) are attached to the downwardly extending front portion 99 of the mounting bracket. Upon actuation of the air cylinders of the piston rods 101 and 102, the piston rods are extended and retracted to move the guide tongue assembly laterally toward and away from the sewing path in the direction of double headed arrow 103. The retraction and extension of the piston rods move the guide tongue assembly between its operative position shown in FIG. 9A in response to the placement of the placement of the waist band material within the sewing path 18, and its inoperative, nonengaging position, shown in FIG. 9B, in response to the sewn edges of the garment approaching the sewing needle at the end of a sewing cycle.

Figure 10B:
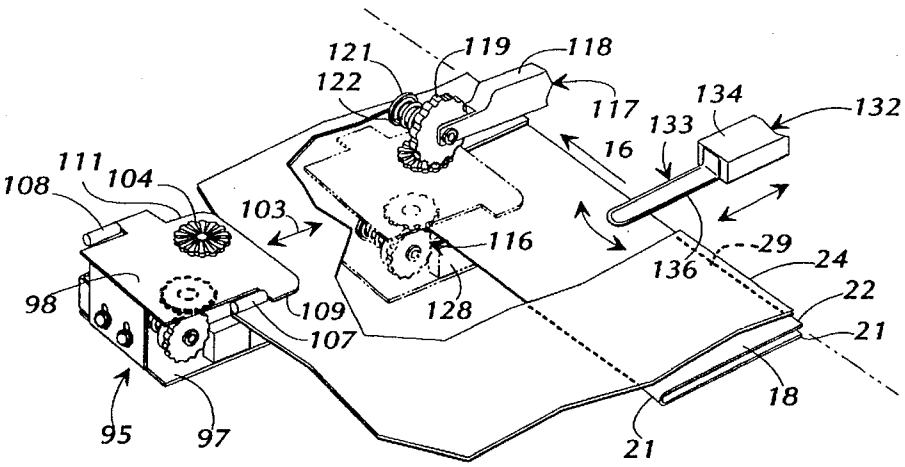
FIG. 10B is a perspective illustration of a portion of the star wheels of the edge guide assembly and idler wheels of the guide tongue assembly and the seam switch, illustrating how the garment parts are engaged thereby.
Figure 10A:
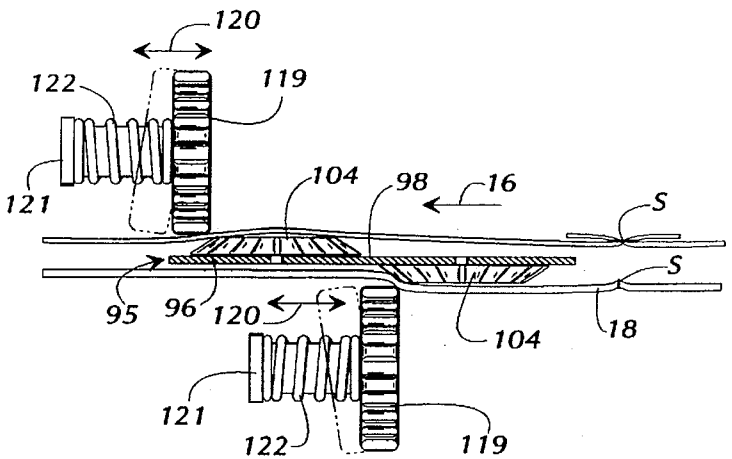
FIG. 10A is a front schematic illustration of the spring mountings of the star wheels and the movement of the star wheels against the springs to enable a seam to pass thereunder.

As FIGS. 9A and 10A illustrate, idler wheels 104 (only one of which is shown) are mounted in the upper and lower surfaces of the upper support plate 96 of the guide tongue assembly 95. The idler wheels are positioned along the sewing path in a staggered relationship. Generally, the idler wheels comprise toothed sprockets formed from plastic or similar material and are rotatable about vertical axes extending through the upper plate.

Additionally, a decurling means 106 (FIGS. 6 and 9B) is mounted to the guide tongue assembly 95, positioned along the upper support plate thereof. The decurling means generally includes a pair of air nozzles 107 and 108 positioned along the upstream and downstream side edges 109 and 111 of the upper support plate 96, and connected to an air supply means (not shown) such as a compressor or an air tank for supplying a flow of air under pressure to the nozzles. The nozzles direct a flow of air across the sewing path, directed at the edges 22, 23 and 24 (FIGS. 1 and 2) of the waist band 18 and shirt body 19. The air flow causes the rolled edges of the waist band and shirt body to be uncurled and flattened prior to being engaged by the sewing needle of the sewing head.

The guide tongue assembly further includes a band edge sensor 112 mounted between the upper and lower plates 96 and 97 and directed upwardly toward the upper plate as shown in FIG. 9 A for detecting the position of the folded edge of the waist band, which is indicative of the presence of the cut edges of the waist band being in or out of the sewing path. The band edge sensor 112 generally is a photo-cell or similar sensing means that detects the folded edge of the waist band by the covering and uncovering of a reflector plate (not shown) mounted on the underside of the work table 43 (FIG. 4) by the movement of the folded edge of the waist band thereacross.

As further illustrated in FIGS. 6, 9A, and 9B, a shirt edge guide assembly 115 is positioned along the sewing path opposite the guide tongue assembly. The edge guide assembly includes lower and upper operative edge guide units 116 and 117, with the lower operative unit mounted to the work table 43 and the upper operative unit mounted to the lower operative unit. The operative edge guide units 116 and 117 have substantially mirror constructions, each including a support arm 118 that extends laterally toward the sewing path 16 (FIG. 9B). The support arms are pivotable from nonoperative positions, shown in FIG. 9B, to operative positions in the sewing path as shown in FIG. 9A upon the star of a sewing operation, and each supports at its distal end a toothed star wheel 119.

The star wheels 119 are rotatably mounted to the support arms 118 by pivot pins 121, with springs 122 positioned between the star wheels and the ends of the pivot pins as shown in FIGS. 5, 10A and 10B. The springs enable some slight movement of the star wheels in the direction of the sewing path. Thus, when ridges or seams in the fabric of the garment parts pass beneath the star wheels, the star wheels tend to give and move slightly, as indicated by arrows 120, (FIG. 10A) to the positions shown in dashed lines to enable the seams or ridge to pass thereunder without catching or binding against the star wheels and jamming the sewing operation.

The star wheels 119 have large gaps between their radially extending, rounded edge teeth 123 so that the waist band 18 and shirt body 19 (FIG. 7) can move along the sewing path 16 in a direction transverse to the star wheels in lightly sliding engagement with respect to the teeth of the star wheels. The star wheels are positioned so as to engage and mesh with the toothed idler wheels 104 of the guide tongue assembly, as shown in FIGS. 5 and 10A, with the shirt body and the waist band engaged therebetween. The star wheels 119 lightly engage the idler wheels 104 of the guide tongue assembly 95, with the waist band and shirt body engaged therebetween, and tend to pull the edges of the waist band and shirt body into or out of the sewing path as the star wheels are rotated so that the waist edges 22, 23 and 24 (FIGS. 1 and 2) of the waist band 18 and shirt body 19 are maintained in matched alignment and are aligned with the sewing path 16.

As shown in FIG. 9B, stepping motors 124 are mounted to the operative edge guide units 116 and 117. Each stepping motor is a reciprocating motor connected to the star wheels 19 in driving relationship by timing belts 126 extending along support arm 118. The motors rotate the star wheels clockwise/counterclockwise as needed to adjust the position at the waist band and shirt body edges in the sewing path.

A sensor army 127 is mounted to the upper operative edge guide unit 117, positioned above and directed toward the sewing path 16 (FIG. 9B). The sensor array generally includes a band sensor 128 and a body edge sensor 129 positioned on opposite sides of the support arm 118 of the upper operative edge guide unit 117. Each of the sensors generally is a photoelectric cell or similar sensing means, such as a laser detector or the like, and is directed toward band and body reflector plates 131 (FIG. 9A).

As indicated in FIG. 9A, the band sensor 128 is directed downwardly toward its band reflector plate 130 so as to detect the presence of the waist band moving into the sewing path. As the waist band is moved over the band reflector plate 130, it breaks the beam of the band sensor. In response, the first spindle assembly 52 (FIG. 4) is caused to be moved longitudinally along the sewing path away from spindles 12, 13 and 14, to stretch the waist band to a first, initially stretched position. The tripping of the band sensor further triggers the movement of the body reflector plate 131 laterally into the sewing path, with the body reflector plate 131 being positioned above the waist band. At the same time, the guide tongue assembly 95 is caused to be moved laterally in the direction of arrow 103' (FIG. 9B) inwardly toward the sewing path into a position above the waist band, and a seam switch 132 likewise is caused to be moved into the sewing path 16 over the waist band.

The body sensor 129, positioned on the downstream side of the support arm 118 of the operative edge guide unit 117. The body sensor is directed downwardly toward the sewing path and toward the body reflector plate 131 once the body reflector plate has been moved into its engaged position in the sewing path. Body sensor 129 functions to detect the waist edge 24 (FIGS. 1 and 2) of the shirt body 19 being in or out of out of the sewing path, which is signaled by the covering and uncovering of the body reflector plate 131 (FIG. 9A). Upon detection of the waist edge of the shirt body being in or out of the sewing path, the motor 124 of the upper operative edge guide unit is actuated and causes the upper star wheel 119 therein to rotate either counterclockwise or clockwise to move the waist edge of the shirt body into or out of the sewing path.

At the same time, the detection of the folded edge of the waist band moving across the beam of band edge sensor 112, indicating the movement of the cut edge of the waist band moving into and out of the sewing path, causes the actuation of the motor 124 of the lower operative edge guide unit 116. The motor rotates the star wheel 119 of the lower operative edge guide unit either counterclockwise or clockwise so as to push or pull the cut edges of the waist band into or out of the sewing path simultaneously with the pushing and pulling of the waist edge of the shirt body into and out of the sewing path. As a result, the waist edges of the waist band and the shirt body are maintained in alignment with one another as they are engaged by the sewing needle of the sewing head. Thus, this reciprocating motion ensures that the waist band material is evenly attached about the waist edge of the shirt body. The positions band edge sensor and body edge sensor also can be adjusted by the operator to adjust the amount of trimming of the shirt body. For example, the position of the eyes can be adjusted to trim ⅛ inch of material or more off of the shirt body and a corresponding portion of the waist band as desired.

As illustrated in FIGS. 6 and 10B, a lever switch 133 is supported on lower operative edge guide unit 116 and is movable into the sewing path upon actuation of band sensor 128. The lever switch 133 includes a switch housing 134 mounted to the piston rods of an air cylinder assembly 136 that extends and retracts its piston rods upon the tripping of the band sensor 126, and a guide finger 137 mounted to the front edge of the housing so as to move into and out of the sewing path with the movement of the switch housing. This places the guide finger 134 between the plies of material, on top of the folded waist band and below the shirt body. With this arrangement, when the plies of material are being sewn together and the previously sewn portion, as represented by the line of stitching 26 (FIG. 10B), approaches and engages the guide finger of the lever switch, the guide finger is deflected and actuates the switch. This causes cylinder assembly 137 to retract the lever switch 133 to permit the stitching 26 to pass on beyond the edge guide assembly 115.

As FIG. 5 shows, an additional pair of guide sensors 138 and 139 are mounted along the sewing path of the shirt body and waist band. Guide sensor 138 is mounted adjacent band edge sensor 112, slightly inward toward the sewing path of the garment and is directed upwardly toward the waist edge of the waist band. Guide sensor 139 is mounted adjacent body edge sensor 129, slightly inward toward the sewing path of the garment and is directed downwardly toward the waist edge of the shirt body. The guide sensors communicate with the upper and lower operative edge guide units 117 and 116 during the initial job or run of the garment. The guide sensors 138 and 139 detect the position of the edges of the waist band and shirt body and engage the upper and lower operative edge guide units to urge the edges of the shirt body and waist band back and forth across the sewing path to positions aligned with the cutter of the sewing machine. As a result, the waist edges of the waist band and shirt body are caused to pass immediately adjacent, but without engaging, the cutter of the sewing machine during the initial jog of the system prior to a sewing operation. This eliminates the tendency of the material to rub against the cutter during the jog, which causes pleating and twisting of the fabric against the cutter. After the jog has been completed, control of the operative edge guide units is transferred to the band and body edge sensors 112 and 129, which control the positioning of the shirt body and waist band during a sewing operation.

As illustrated in FIG. 6, garment ejector 51 is positioned downstream from body reflector plate 131, and is movable into the sewing path upon actuation of the sewing assembly. The garment ejector includes a support plate 141 that is mounted to the work table 37. Support housing 142 is mounted over support plate 141 and accommodates a pneumatic cylinder 143. The pneumatic cylinder 143 is connected to an ejector plate 144 having a downwardly turned distal end 146, and an upwardly curled or hooked catch portion 147 positioned rearwardly from the distal end. When cylinder 143 is actuated, it pushes ejector plate 144 forwardly across and beyond the sewing path of the sewing head 38, which causes the work product to be pushed out of the sewing path and off of the spindles 11–14. Initially, the ejector is engaged in response to the tripping of the lever switch 133 and urges the work product progressively out of the sewing path so that the sewing machine sews off of the garment. Thereafter, the movement of the ejector is halted for a short time while the sewing machine continues to sew and forms a thread chain 32 after which the ejector moves the garment further forwardly and off of the spindles.

A stitch counter 148 (FIG. 4) is mounted to the work table 37 of the waist band attachment system 40 and is connected to the sewing head 38. The stitch counter 148 generally comprises a programmable computer or similar processing unit having a sensing means for recording the number of stitches sewn in the waist band and shirt body by the sewing head. The stitch counter is programmed with a first stitch count of a desired number of stitches to be formed in garment depending on the size of the garment. Upon detection of the sewing of the desired number of stitches by the stitch counter 148, the second guide spindle assembly 75 is reactivated to sense the tension or lack thereof in the garment. If the proximity switch 92 (FIG. 8) of the second guide spindle assembly detects an absence of the spring block 87 in close proximity therewith, indicating that the garment is still under sufficient tension to cause the nose portion 81 of spindle 13 to be pulled rearwardly along the sewing path, the spindles 13 and 14 are maintained in their currently set position as no further stretching is required. However, if the proximity switch 92 detects the presence of the spring block 87 in close proximity therewith, indicating that the tension in the garment has been substantially relieved or decreased so that the nose potion of spindle 13 is moved back into alignment with the body of spindle 13 and the spring block is permitted to move toward the support plate 79, cylinder 77 is engaged and moves the carriage 79 further along its length and away from the sewing path. This causes the spindles 13 and 14 to be moved further outwardly along the sewing path to further stretch and tension the waistband and shirt body of the garment. As a result, the waist band and shirt body are flattened to prevent wrinkles from being formed adjacent the pressure foot and needle of the sewing machine, and being sewn in the finished garment.

A tension opener assembly 150 (FIGS. 4, 5 and 11) is mounted to the sewing machine, positioned adjacent the thread tensioner 41 for the needle thread 40 of the sewing machine. The tension opener assembly includes an air cylinder 151 connected to an air supply (not shown), and a push rod 152 connected to the air cylinder 151. The push rod is mounted above the tension plates 42 and 43 of thread tensioner 41 and has a pointed end adapted to engage and move between the tension plates. The push rod 152 is extended and retracted by the actuation of the air cylinder toward the end of a sewing operation and tends to urge the tension plates apart. The air cylinder 151 is actuated by the stitch counter 148 counting a second stitch count of stitches being formed in the garment following the tripping of the lever switch 133 and, in response, moves the push rod 152 between the tension plates 42 and 43, thus releasing the tension on the needle thread 40.

Figure 11:
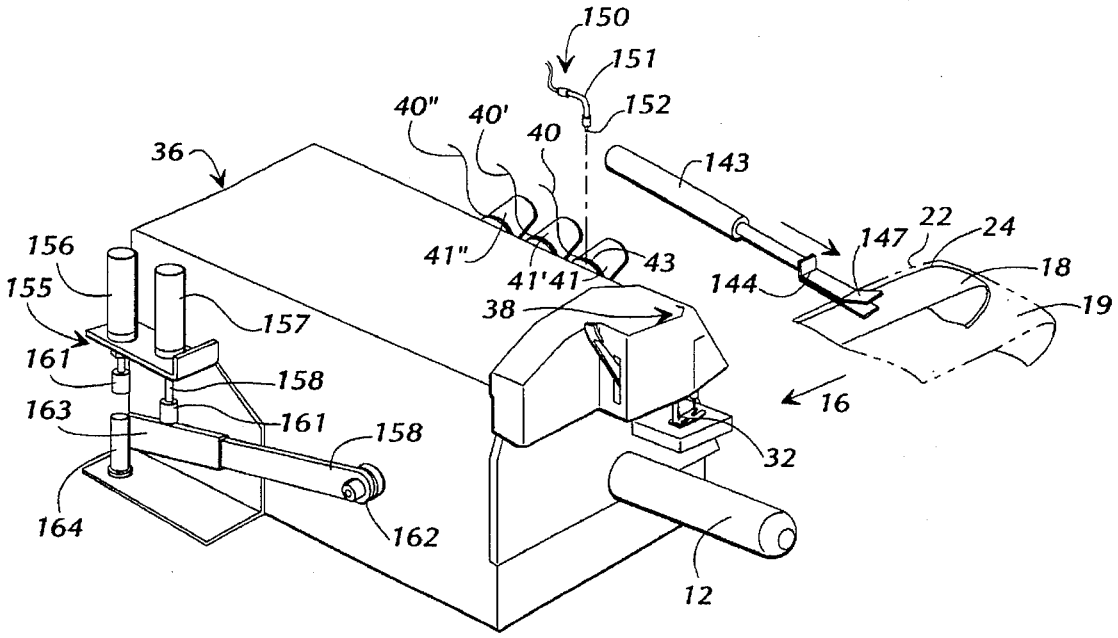
FIG. 11 is a perspective view of the sewing machine, showing the dual footlift cylinder assembly for lifting the presser foot slightly at the completion of the sewing operation and showing the tension opener assembly mounted at the needle thread tensioner.

As FIG. 11 further illustrates, a presser foot lift cylinder assembly 155 is mounted to a downstream side of the sewing machine 36 and is connected to the presser foot 39 of the sewing machine to control the raising and lowering of the presser foot. The presser foot lift cylinder assembly 155 includes first and second air cylinders 156 and 157 positioned in a vertically extending, parallel alignment, and lever 158 pivotally mounted to the sewing machine and extending beneath the cylinders 156 and 157. Each air cylinder has a piston rod 159 having a foot 161 attached to its free end. The lever 158 is an elongated bar connected at a first end 162 to the presser foot 39 by a linkage (not shown) and having a second end 163 positioned to be engaged by the feet of the cylinders. As the feet of the cylinders engage the second end 163 of the lever, causing the lever to pivot downwardly, causing the presser foot to be raised. A stop 164 is positioned adjacent the second end of the lever, beneath the foot 161 of the cylinder 156. The stop is an upstanding bar or rod that limits the downward movement of the foot of cylinder 156 to thus limit the pivoting movement of the lever.

Cylinder 156 is actuated by the tripping of the lever switch 133 (FIG. 6) by the finished garment. In response, cylinder 156 (FIG. 11) extends its foot 161 to urge the second end 163 of the lever 158 downwardly a short distance. As a result, the presser foot 39 is raised approximately ⅛ of an inch to enable the garment to be moved out from under the sewing head by the ejector. Upon completion of a sewing operation, cylinder 157 extends its foot 161 against the lever, moving the lever to its fully lowered position to cause the presser foot to be raised fully for removal of the garment.

A thumb swipe switch 170 (FIG. 4) is mounted above the right side guide spindle assembly 75, to the right of the edge guide assembly. Upon contact of the switch by the operator, the system is placed in operation. This allows the operator of the system to place the garment parts about the spindles 11–14 and with only a small movement of her thumb through the recess of the thumb swipe switch, begin the automatic operation of the system.

Figure 12:
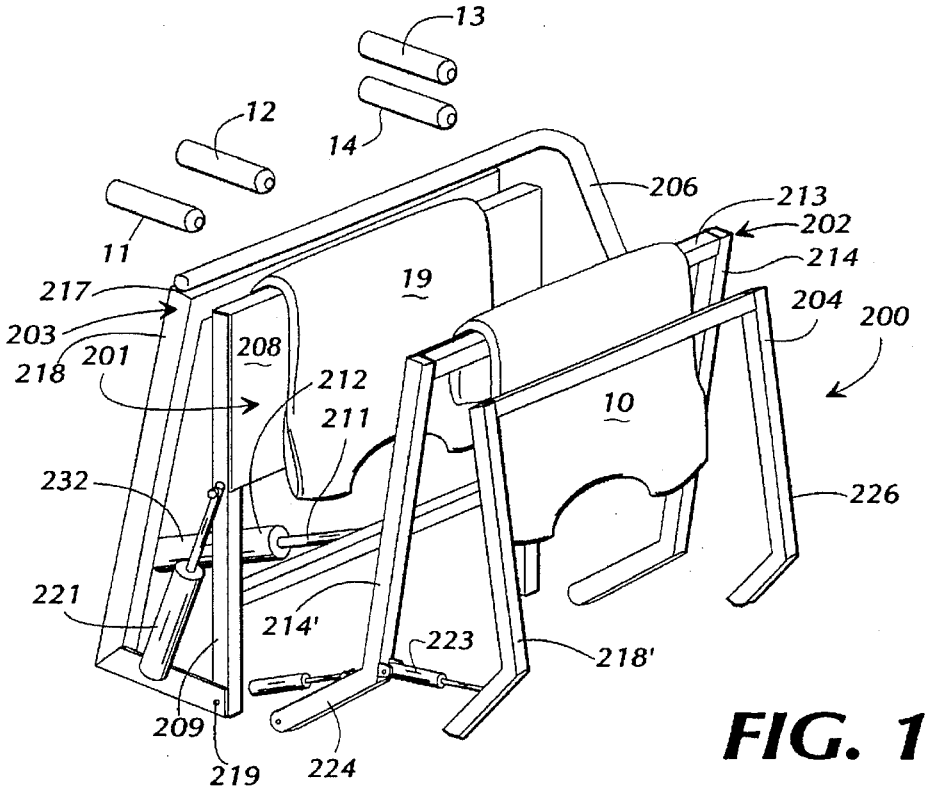
FIGS. 12–16 are perspective, progressive illustrations of the stacker, showing how the stacker functions at the end of the cycle of the sewing head.

As FIGS. 4 and 12 illustrate a stacker 200 is positioned adjacent the work table of the waist band attachment system for maintaining a supply of unfinished shirt bodies for placement on the spindles 11–14, and for automatically removing the completed work product after the sewing cycle has been completed.

As illustrated in FIG. 12, the stacker 200 includes a supply frame 201 and an accumulator frame 202, positioned between the supply frame 201 and the work table; clamp bars 203 and 204 mounted to the supply and accumulation frames, respectively, and a wiper bar 206. As illustrated in FIG. 4, the supply frame, accumulator frame and clamp bars all are pivotally mounted at their lower ends on a common support 207 so as to be pivotable toward and away from one another as illustrated in FIGS. 12–16. The supply frame generally is rectangularly shaped, having an upper plate 208 mounted on and supported by legs 209 attached to each side of the upper plate, and a cross bar 211 extending between the legs below the upper plate. The supply frame supports a supply of shirt bodies 19 on its upper plate. The position of supply frame 201 is controlled by a pneumatic cylinder 212 which is mounted to a stationary support and is connected to the cross bar 211 of the supply 201 frame.

Likewise, the accumulator frame 202 generally is rectangularly shaped and includes an upper bar 213 supported by spaced parallel legs 214, and supports a stack of finished garments 10 folded over its upper bar 213. The position of the accumulator frame is controlled by a pair of cylinders 216 (only one of which is shown) mounted on a stationary support and are connected to the legs 214 of the accumulator frame.

Figure 13:
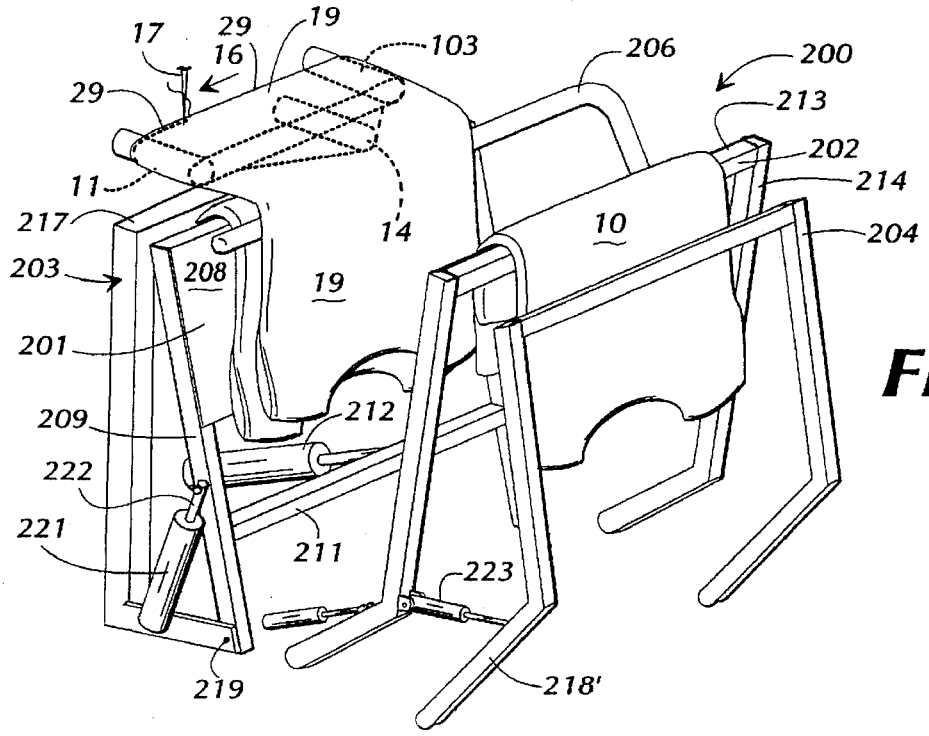
Figure 14:
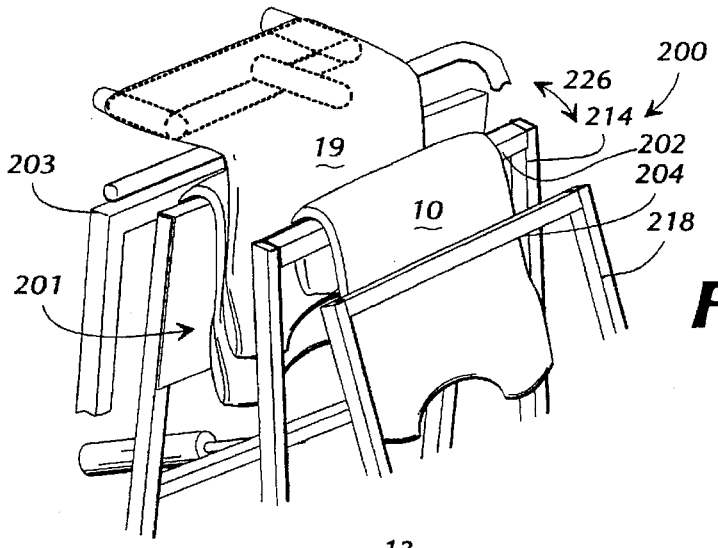

As shown in FIGS. 12–16, the clamp bars 203 and 204 generally move in unison with the supply and accumulator frames 201 and 202, but additionally can be moved toward and away from the supply and accumulator frames between clamped and unclamped positions. Each of the clamp bars 203 and 204 generally is substantially rectangularly shaped and includes an horizontally extending upper bar 217 adapted to engage the upper plate 208 and upper bar 213 of the supply and accumulator frames 201 and 202 when the clamp bars are in their clamping positions against the supply and accumulator frames as shown in FIGS. 12 and 14. The clamp bars further include a pair of spaced vertically extending legs 218 supporting the upper bar 217. As FIG. 12 illustrates, the legs 218 of the first clamp bar 203 are pivotally attached at their distal ends to the lower ends of the legs 209 of the supply frame 201 by pivot pins 219 (only one of which is shown) to enable the clamp bars to pivot between their clamped and unclamped positions.

A pneumatic cylinder 221 is mounted to one of the legs 214 of the clamp bar 203 and includes a piston rod 222 attached at its free end to the adjacent leg. As the pneumatic cylinder 221 is actuated, it extends and retracts its piston rod 222, which causes the clamp bar 203 to pivot about its pivot pin 219 rearwardly away from the supply frame 201 or forwardly towards damping engagement with the upper bar of the supply frame as illustrated in FIGS. 12 and 13. Similarly, a pneumatic cylinder 223 is pivotally attached to a forwardly facing side surface of leg 214' of the accumulator frame, positioned between the accumulator frame and its clamp bar 204. These pneumatic cylinders include a piston rod 224 that is attached to the adjacent leg 218' of clamp bar 204 such that upon actuation of the cylinder 223, piston rod 224 is extended and retracted so as to cause the clamp bar 204 to be pivoted toward and away from the accumulator frame, into and out of its clamping positions with respect to the accumulator frame.

Figure 15:
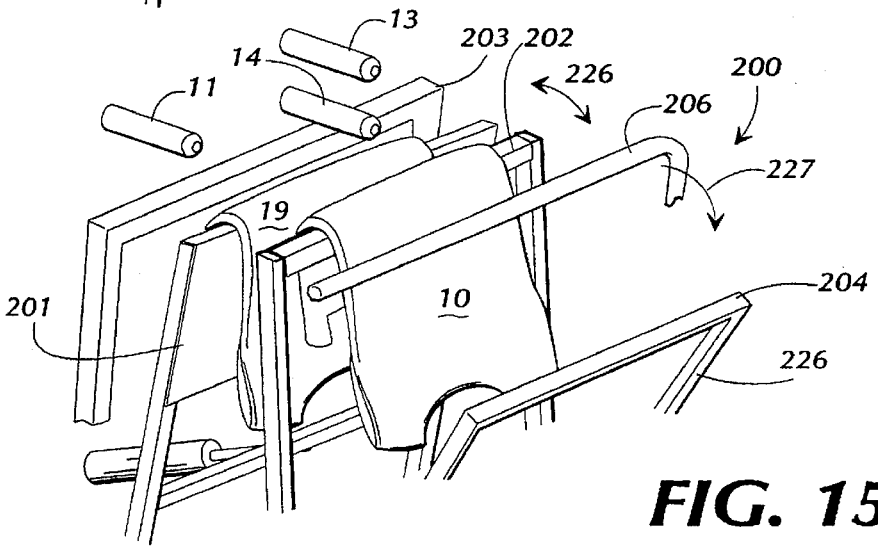
Figure 16:
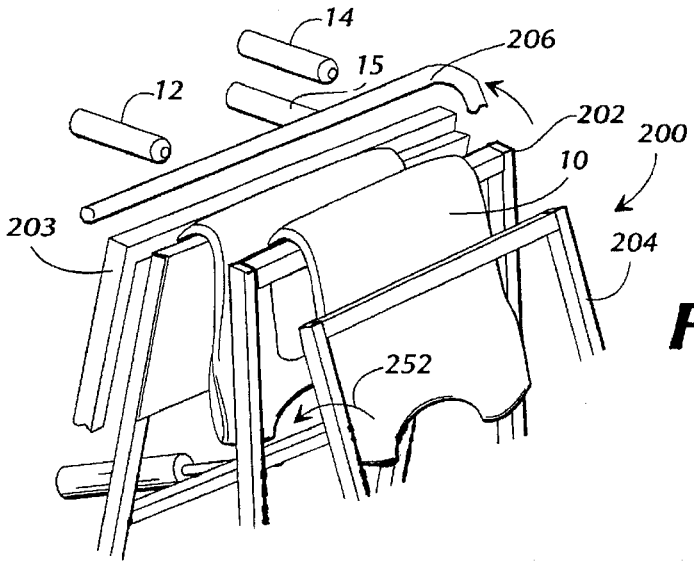

As shown in FIGS. 12 to 16, the wiper bar 206 generally is a substantially L-shaped bar or rod having a horizontally extending portion that projects forwardly that projects over and extends parallel to the upper surfaces of the upper plate 208 and upper bar 213 of the supply and accumulator frames. The wiper is pivotable in an arcuate motion across the supply and accumulator frames as shown in FIGS. 13 to 16 in order to pick up and remove a finished garment from the spindles of the waist band attachment system, causing the garment to be folded over the upper bar of the accumulator frame, stacked over previously finished garments. The wiper bar is actuated by a pneumatic cylinder that moves the wiper bar in an arcuate motion from a first position in front of the supply frame 201 and its clamp bar 203, as shown in FIG. 12, in the direction of arrows 226 to a second position over the accumulator frame 202, and (as shown in FIG. 15), and back to its initial position as shown in FIG. 16 to remove a finished garment from the waist band attachment system.

OPERATION

FIG. 17 provides a schematic illustration of the cycle time of the waist band attachment system.

Function 1: The operator folds a waist band 18 as indicated in FIGS. 1 and 2 so that its edges are in overlying alignment and inserts the waist band 18 about the spindles 11–14. When the operator loads the waist band 18 on the system, the placing of the waist band about the spindles 11–14, is detected by a band sensor 128 (FIGS. 4 and 5). This causes guide tongue assembly 95 to be moved laterally in the direction of arrow 103' into the sewing path. At the same time, the first spindle assembly 52 is moved to the left as cylinder 73 is actuated in response to the tripping of band sensor 128, and a body reflector plate 131 and a seam switch 132 are moved into the sewing path positioned above the waist band (FIG. 9A) to expand the waist band to an initial stretched position.

Once the waist band 18 has been properly placed as described, the operator then retrieves the waist edge 24 of a shirt body 19 from the stack of shirt bodies stacked on the supply frame 201 (FIGS. 12–16) and places the waist edge 24 of the shirt body 19 about the spindles 11–14 (FIG. 3).

Function 2: Once the shirt body is in place about the spindles, the operator actuates the sewing cycle of the system by passing her thumb through the thumb swipe 170 upon which the supply frame 201 is moved by its cylinder 212 toward the waist band attachment system (FIG. 13), to an out of the way position. Functions 3, 4, 5, and 6 are then actuated simultaneously.

Function 3: Puller wheel 45 (FIG. 6) moves down and rotates against the spindle 12 to clamp the garment parts against the spindle and to pull the garment parts about the rotatable spindles 11–14.

Function 4: The garment parts are started along an initial jog to align the waist edges of the garment parts prior to sewing. Guide sensors 138 and 139 (FIG. 5) detect the position of the waist edges of the waist band and shirt body in the sewing path. The guide sensors engage the upper and lower operative edge guide units which control the position of the waist band and shirt body by moving the waist band and shirt body laterally across the sewing path. The waist edges of the waist band and shirt body thus are aligned during the initial jog and tend to move immediately adjacent the cutter of the sewing machine so as to avoid engaging the cutter during the initial jog to prevent pleating of the material. Once the initial jog is completed, control of the edge guide units is switched to the band edge and body edge sensors 112 and 129 for sewing, and the waist edges of the waist band and shirt body are moved into engagement with the sewing needle and cutter gradually to avoid pleating and twisting of the garment parts as the sewing cycle commences. At the same time, cylinder 77 (FIG. 8) of the second guide spindle assembly 75 is actuated, causing carriage 78 to be moved outwardly toward the right of the waist band attachment system. As a result, spindles 13 and 14 are moved outwardly along the sewing path causing the waist edges of the waist band and shirt body to be further stretched and tensioned prior to sewing. The garment body and waist band are stretched by the movement of spindles 13 and 14 of the second guide spindle assembly 75 along the sewing path until the tension created in the garment body by this stretching is sufficient to overcome the force of spring 89 and cause the nose portion 81 of spindle 13 to be pulled in the opposite direction from the movement of spindle 13. The movement of the nose portion causes pivot arm 82 to pivot about pivot pin 85, pivoting spring arm 86 and causing spring block 87 to be moved away from the support plate. This movement of the spring block is detected by switch 92 in response to which the stretching of the garment is halted. The sewing of the garment then is commenced to form the stitching 26 until the garment is completed. The sewing of the garment is not permitted to start, however, until the tensioning of the garment by the second guide spindle assembly is completed.

Function 5: The upper operative unit 117 (FIGS. 6 and 9A) of guide assembly 115 controls the position of the edge of the shirt body, by the detection by body sensor 129, the waist edge of the shirt body being in or out of the sewing path, and covering and uncovering the body reflector plate 131. In response, the motor 124 is actuated to rotate star wheel 119 clockwise and counterclockwise to urge the shirt edge back to its proper position.

At the same time, band edge sensor 129 detects the position of the folded edge 21 (FIG. 2) of the waist band, which is indicative of the presence and absence of the waist edges 22 and 23 in the sewing path 16. In response, motor 124' (FIG. 9A) of the lower operative unit 116 of the edge guide assembly is actuated and rotates star wheel 119' in a reciprocable fashion causing the edges 22 and 23 (FIG. 2) of the waist band to be moved back and forth into and out of the sewing path as the folded edge 21 crosses the beam of band edge sensor 112 (FIG. 5).

Function 6: Air is supplied to the air nozzles 107 and 108 (FIG. 9A) of the decurling means 106 to remove the curl from the stretched edges of the waist band and shirt body.

Function 7: The system is allowed to operate about an initial jog for a predetermined time before sewing head 38 (FIG. 5) is actuated. This enables the waist edges of the garment parts to be moved into matched alignment before being sewn together and allows any previously curled portion of the waist edge of a shirt body to pass on through the sewing head, until the flattened portion of the waist edges pass from the edge guide assembly 115 through garment ejector 51 and to sewing head 38. At this point, presser foot 39 moves down into contact with the garment parts and the sewing needle 17 begins its sewing function.

Function 8: The system is permitted to operate for a predetermined stitch count. Once the stitch count has been achieved, the proximity switch 92 (FIG. 8) of the fight spindle assembly 75 is actuated. The proximity switch detects the absence or presence of spring block 87 in close proximity therewith, which indicates the sufficiency or lack of tension in the garment. If the spring block is detected in close proximity, indicating a relaxing of tension in the garment, cylinder 77 is actuated to move spindles 13 and 14 outwardly to the fight to stretch the garment parts further. This function is desirable so as to avoid the formation of a wrinkle or pleat just prior to the position of the presser foot 39 (FIG. 5). With the garment stretched further as the previously sewn portion of the garment begins its approach to the sewing needle 17, any such pleats tend to Function 9: As the previously stitched portion of the garment (FIG. 10B) approaches the sewing head, the guide finger 136 of seam switch 132, which protrudes between the plies of material, will be engaged by the first stitches 29 (FIG. 3A), sewn in the waist band and shirt body causing the guide finger to be deflected and causing the seam switch to be activated.

Function 10: Upon engagement of the seam switch by the line of stitching of the garment, the guide tongue assembly is moved in the direction of arrow 103 out of the sewing path and body reflector plate 131 and seam switch 132 are retracted out of the path of the oncoming stitches.

Function 11: After a second predetermined stitch count has been counted by the stitch counter following the deflection of the seam switch, the ejector 51 is moved across the sewing path by the longer of its cylinders. This causes the edges of the garment parts to be moved out of the sewing path, so that the sewing needle 17 (FIG. 3B) sews off of the garment parts, and forms a thread chain 32 extending from the garment parts.

Function 12: At the same time that the ejector 51 is into engagement with the garment, a first air cylinder 156 (FIG. 11) of a presser foot lift cylinder assembly extends its piston rod 159 inwardly and its foot 161 engages lever 158. The lever is connected to the presser foot 39 such that as the lever is pivoted downwardly, the presser foot is raised. The downward motion of the foot 161 of the first air cylinder is limited by a stop 164 positioned adjacent the second end of the lever. As a result, the mount of movement of the lever is limited. Correspondingly, the presser foot is raised approximately ⅛" in response to the actuation of first air cylinder 156. The limited raising of the presser foot is sufficient to enable the garment to be urged outwardly from beneath the sewing head of the sewing machine, without the presser foot engaging and interfering with the continued sewing operation of the needle.

Function 13: Once the line of stitching has been sewn off of the garment, the garment is further moved along the sewing path per a predetermined stitch count or upon the further movement of the garment is halted with the point where the line of stitching 29 (FIG. 3B) moves off of the garment. At this point, the further movement of the garment along the sewing path is halted, while the sewing head of the sewing machine continues to sew and create a thread chain 32. At approximately the same time, a thread opener assembly 150 is engaged upon the detection of the third predetermined stitch count, and causes push rod 152 to be extended between the thread plates 42 and 43 of the needle thread tensioner 41 so that the tension on the needle thread 40 is released. As a result, the thread chain formed by the needle after the needle has sewn off of the garment includes needle and looper threads that are approximately equivalent in length. Having the needle and looper threads of the thread chain being approximately equivalent in length significantly reduces the possibilities of the individual threads being pulled or picked thus becoming separated so that the portion of the thread chain remaining with the garment after trimming becomes brayed with elongated pigtails that have to be further trimmed in a later processing operation.

The garment is moved to a position where the stitching exits the garment is approximately equal with the trimmer of the sewing machine and the further forward motion of the garment is halted. The thread chain then is drawn between the blades of the trimmer by a vacuum means. The thread chain is severed by the trimmer, leaving the garment with a shortened tail portion of the thread chain, approximately ¼"–½" in length, remaining connected thereto.

Function 14: Stacker 220 (FIGS. 12–16) begins its stacking function, as previously described.

Once the sewing head has sewn off of the work product, the system is deenergized, so that the spindles 11, 13 and 14 retract to their original positions close to the sewing head, garment ejector 51 retracts to its out of the way position. The accumulator frame 202 and its clamp bar 204 move as indicated by arrows 226 in FIGS. 13–14, to clamp against the trailing portion of the shirt body 19. With the shirt body clamped between the accumulator frame and its clamp bar, the wiper bar 206 begins its movement (FIG. 15) as indicated by arrow 227 toward the accumulator frame. The wiper bar lifts the shirt body and begins to move the body on to the accumulator frame while, and clamp bar 204, at the same time, begins its movement away from its clamping position, as indicated by arrow 228. This causes the shirt body 17 to be flipped over the accumulator frame.

Once the shirt body has been flipped over the accumulator frame, the clamp bat 204 returns into clamping relationship with respect to accumulator frame as indicated by arrow 229. Once clamp bar 204 has achieved clamping relationship with respect to the shirt body 17 and the accumulator frame, the clamp bar and accumulator frame pivot back to their out of the way positions as indicated in FIG. 12.

As illustrated in FIG. 4, a stationary accumulator rail 230 extends from adjacent the stacker 200 out to a lateral position beside the system. When a bunch of completed garments 10 have been accumulated on accumulator frame 202, the operator can simply slide the accumulated bunch laterally off the accumulator frame where the bunch can be retrieved by the operator and placed on a rolling trolley, etc. for subsequent processing. The system is now ready for a second cycle.

While the invention has been described as a method and apparatus that operates to connect a continuous loop waist band to the waist edge of a shirt body, it will be understood that the invention can be used to connect waist bands to the waist edge of pants, and to connect other continuous loop work products together. The terms "shirt," "garment" and "waist band" should receive a broad meaning.

It will be understood that the foregoing relates only to a preferred embodiment of the present invention, and it is anticipated that numerous changes and modifications may be made therein without departing from the spirit and scope of the invention as set forth in the following claims.

We claim:

1. A method of attaching a looped waist band to the continuous waist edge of a garment body, comprising the steps of:

placing the waist band about a series of support spindles;

moving at least one of said support spindles in a direction to stretch the waist band to an initial stretched position;

placing the garment body in a surrounding, overlying relationship with respect to the waist band with the waist edge of the garment body substantially aligned with an edge of the waist band;

prefeeding the waist band and waist edge of the garment body along a sewing path to align the edges of the garment body and waist band;

as the waist band and waist edge of the garment body are prefeed along the sewing path, moving one of said support spindles in a direction to apply more tension to the waist band and waist edge of the garment body;

sensing the increasing tension of the garment body as the support spindle stretches the garment body;

in response to stretching the garment body to a predetermined tension, stopping stretching movement of the support spindle to avoid over-tensioning the garment body; and initiating sewing of the waist band and garment body to attach the waist edges of the waist band and garment body.

2. The method of claim 1 and further comprising the steps of:

counting stitches formed in the waist band and garment body during a sewing operation;

upon reaching a desired stitch count, sensing the tension in the garment body; and in response to sensing less than a predetermined tension in the garment body after the stitch count, moving the support spindle to further stretch the garment body to maintain the predetermined tension therein.

3. The method of claim 1 and wherein the step of stretching the waist band comprises moving one of the spindle assemblies outwardly from the sewing path.

4. The method of claim 1 and wherein the step of sensing the tensioning of the garment body comprises the step of engaging and moving a nose portion of a spindle with the garment body in response to increasing the tension applied to the garment body.

5. The method of claim 1 and wherein the step of initiating sewing of the waist band and garment body comprises lowering a presser foot and sewing needle into engagement with the garment body upon completion of the step of prefeeding, and forming stitches in the waist band and garment body to attach the waist band and garment body together.

6. A system for attaching an edge of a looped waist band to the waist edge of a garment body, comprising:

a sewing machine poritioned along a sewing path and having a sewing means for forming stitches in the waist band and garment body to attach the waist band and garment body;

a plurality of spindles adjacent said sewing machine about which the waist band and waist edge are mounted;

a means for moving one of said spindles to stretch the garment body;

means for sensing the tension of the garment body and halting further movement of said spindle and the stretching of the garment body in response to the sensing of a predetermined tension in the garment body, and for monitoring the tension of the garment body and controlling further movement of said spindle during sewing of the waist band and garment body to maintain said predetermined tension in the garment body to retard formation of wrinkles in the garment body during sewing; and drive means for moving the garment body and waist band along the sewing path for sewing.

7. A system for attaching an edge of a looped waist band to the continuous waist edge of a garment body, comprising:

a sewing machine positioned along a sewing path and having a sewing means for forming stitches in the waist band and garment body to attach the waist band and garment body;

a plurality of spindles adjacent said sewing machine about which the waist band and waist edge are mounted;

a means for moving one of said spindles to stretch the garment body;

means for sensing the tension of the garment body and halting further movement of said spindle and the stretching of the garment body in response to the sensing of a predetermined tension in the garment body, said one spindle including a spindle body and a nose portion that is movable laterally with respect to said spindle body in response to increases and decreases in tension in the garment body, a spring block connected to said nose portion and movable in response to the movement of said nose portion due to increases in tension in the garment body, which movement is detected by said sensing means in response to which movement of said spindle is halted; and drive means for moving the garment body and waist band along the sewing path for sewing.

8. The system of claim 7 and wherein said sensing means comprises a proximity sensor mounted adjacent said spring block to detect the presence and absence of said spring block adjacent thereto.

9. The system of claim 7 and wherein said spring block includes a pocket, a compression spring received within said pocket and which biases said spring block against movement, and a fastener means received through said spring block to secure said spring therein and for adjusting tension on said spring to adjust the tension applied to the garment body that is required to trigger said sensing means to halt further stretching of the garment body by said spindle.

10. The system of claim 9 and further including a pivot arm connected at one end to said nose portion of said spindle and movable therewith, and a spring arm mounted at one end to said pivot arm and attached at an opposite end to said spring block, whereby as said nose portion is moved laterally upon exertion of tension on the garment body sufficient to overcome the biasing of said spring, said pivot arm pivots said spring arm, in response to which said spring block is moved.

11. The system of claim 6 and further including edge guide means for maintaining the edges of the waist band and garment body in alignment with the sewing path upstream from said sewing machine and adapted to engage and move the edges across the sewing path in independent reciprocating motions in response to the detection of the presence and absence of the edges of the waist band and garment body.

12. The system of claim 11 and further including sensor means for controlling said edge guide means, said sensor means comprising a body sensor positioned above the sewing path in a position to detect the waist edge of the garment body, and a band edge sensor positioned below the sewing path for detecting an edge of the waist band.

13. The system of claim 11 and further including guide sensors mounted along the sewing path for detecting the edges of the waist band and garment body and controlling the edge guide means during a prefeed of the waist band and garment body along the sewing path to move the edges across the sewing path to align the edges and maintain the edges out of engagement with a cutter of the sewing machine prior to the start of the sewing operation.

14. The system of claim 6 and further including decurling means positioned in the sewing path upstream of said sewing machine for removing any curl from the edges of the waist band and the garment body as the edges move toward said sewing machine.

15. The system of claim 6 and further including means for moving said spindles along the sewing path to stretch the waist band and garment body.

16. The system of claim 15 and wherein said means for moving said spindles comprise pneumatic cylinders.

17. A system for attaching the edges of a stretchable loop waist band to the waist edge of a garment body, which system includes a sewing machine for sewing the waist band and garment body together to form a finished garment, the improvement therein comprising:

spindle means about which the waist band and waist edge of the garment body are received for holding the edges of the waist band and garment body in a matched relationship;

drive means for moving the matched edges along a sewing path into the sewing machine;

said spindle means including a first spindle adapted to move and stretch the waist band to an initial tension and a second spindle adapted to move for stretching the garment body and waist band;

said second spindle including means responsive to the stretching of the garment body to a desired tension for controlling the movement of said second spindle and maintaining the desired amount of tension of the garment body to avoid formation of wrinkles in the garment body during a sewing operation; and said means responsive to the tensioning of the garment comprising a pivot arm movable in response to the tension of the garment bearing against said second spindle, a block connected to said pivot arm so as to be moveable in response to movement of said pivot arm and means for sensing the position of said block for halting the further movement of said second spindle upon reaching a desired amount of tension in the garment body.

18. The system of claim 17 and wherein said means for sensing comprises a proximity sensor.

19. The system of claim 17 and further including a cylinder means for moving said second spindle along said sewing path.

20. The system of claim 17 wherein said second spindle comprises a body, and a nose portion movable laterally with respect to said body of said spindle.

21. The system of claim 17 and wherein said block includes a pocket, a spring received within said pocket for exerting a biasing force against said block to retard movement of said block, and a fastener received through said pocket an engaging said spring for adjusting said biasing force exerted against said block to adjust the tension in the garment body.

22. A method of attaching an edge of a looped waist band to the continuous waist edge of a garment body, comprising the steps of:

placing the waist edge of the garment body in surrounding overlying relationship with respect to the waist edge of the waist band, in substantially edge-to-edge alignment therewith;

stretching the overlaid portions of the waist band and garment body until the garment body is under a desired amount of tension;

sensing the application of the desired amount of tension of the garment body and controlling the stretching of the garment body in response thereto;

advancing the aligned edges of the waist band and garment body along a sewing path under tension through a sewing station and forming stitches in the waist band and garment body along their aligned edges to connect the waist band and garment body together; and as the edges of the waist band and garment body are advanced through the sewing station during a sewing operation, again sensing the tension of the garment body and adjusting the stretching of the garment body to maintain the desired tension on the garment body.

23. The method of claim 22 and wherein the step of again sensing the tension further includes the step of as the waist band and garment body are advanced along the sewing path, detecting a predetermined number of stitches formed in the waist band and garment body.

24. A method of attaching garment parts, comprising steps of:

placing the garment parts in surrounding overlying relationship with respect to one another on a support spindle assembly in substantially edge-to-edge alignment therewith:

stretching the overlaid portions of the garment parts until the garment parts are under a desired amount of tension;

moving a nose portion of a spindle of the support spindle assembly rearwardly with the stretching of the garment parts, parallel to the sewing path upon the tensioning of the garment parts, in response the movement of the nose portion moving a spring block connected to the nose portion, detecting the movement of the spring block and stopping the movement of the second spindle assembly to stop the stretching of the parts with the desired amount of tension therein; and advancing the aligned edges of the garment parts along a sewing path under tension through a sewing station and forming stitches in the garment parts along their aligned edges to connect the garment parts.

25. The method of claim 22 and wherein the step of stretching the overlaid portions of the waist band and garment body comprises moving a first support spindle in a first direction along the sewing path and moving a second support spindle in a second direction along the sewing path.

26. A method of attaching a stretchable looped band to a continuous edge of a stretchable garment body of a larger breadth than the band, comprising the steps of:

placing the stretchable band about a plurality of support spindles;

placing the edge of the stretchable garment body about the spindles in overlying relationship with respect to the band with the edge of the garment body matched with an edge of the band;

stretching the band and garment body with the support spindles;

sensing the tension of the garment body as it is being stretched by the support spindles;

terminating the step of stretching the band and garment body with the support spindles in response to sensing a predetermined amount of tension in the garment body;

advancing the band and the garment body through a sewing station;

sewing together the matched edges of the garment body and band; and as the matched edges of the garment body and band are sewn, sensing the tension of the garment body and moving the support spindles to maintain the tension of the garment body at the predetermined amount of tension to avoid formation of wrinkles in the garment body.

27. A method of attaching the edges of work products comprising the steps of:

moving the work products along a sewing path toward a sewing needle of a sewing machine with the edges of the work products substantially matched;

sewing the edges of the work products together;

as the edges of the work products are moved toward the sewing needle, independently engaging and reciprocating the work products across the sewing path with star wheels of upper and lower edge guide units to maintain the edges of the work products in a substantially matched alignment; and in response to the engagement of potions of increased thickness in the work products with the star wheels, moving the star wheels in the direction of the sewing path to enable the portion of increased thickness to pass by the star wheels without disrupting the movement of the work products along the sewing path.

28. A system for attaching the edges of work products comprising:

a sewing machine including drive means for moving the work products along a sewing path and having aa sewing means for connecting the edges of work products;

edge guide means for maintaining the edges of the work products in substantially matched alignment and in alignment with the the sewing path upstream from the sewing means, said edge guide means including a star wheel adapted to engage and move the work products laterally in independent reciprocating motions across the sewing path to maintain the edges of the work products in substantially matched alignment; and means for yieldably urging said star wheel toward engagement with the work products and the sewing path positioned adjacent said star wheel to enable said star wheels to move along the sewing path in response to the engagement of portions of increased thickness of the work products as the portions of increased thickness engage and pass said star wheels to prevent said star wheels from bonding in the work products and disrupting a sewing operation.

* * * * *